US009649517B2

(12) United States Patent
Csizmadia

(10) Patent No.: US 9,649,517 B2
(45) Date of Patent: May 16, 2017

(54) FALL ARRESTER HAVING DAMPING, AND DAMPING ELEMENTS FOR A FALL PROTECTION DEVICE

(71) Applicant: Péter Csizmadia, Györ (HU)

(72) Inventor: Péter Csizmadia, Györ (HU)

( * ) Notice: Subject to any disclaimer, the term of this patent is extended or adjusted under 35 U.S.C. 154(b) by 0 days.

(21) Appl. No.: 14/769,894

(22) PCT Filed: Feb. 21, 2014

(86) PCT No.: PCT/DE2014/000073
§ 371 (c)(1),
(2) Date: Oct. 23, 2015

(87) PCT Pub. No.: WO2014/127760
PCT Pub. Date: Aug. 28, 2014

(65) Prior Publication Data

US 2016/0059054 A1 Mar. 3, 2016

(30) Foreign Application Priority Data

Feb. 22, 2013 (DE) ..... 10 2013 002 971

(51) Int. Cl.
*E04G 1/36* (2006.01)
*A62B 35/00* (2006.01)
(Continued)

(52) U.S. Cl.
CPC ..... *A62B 35/0068* (2013.01); *A62B 35/04* (2013.01); *E04G 21/328* (2013.01); *E04G 21/329* (2013.01)

(58) Field of Classification Search
CPC . E04G 21/328; E04G 21/329; A62B 35/0068; A62B 35/04
(Continued)

(56) References Cited

U.S. PATENT DOCUMENTS 4,607,724 A * 8/1986 Hillberg ..... E04G 21/3261 182/3
6,131,360 A * 10/2000 Dalen ..... E04B 1/4178 52/379
(Continued)

FOREIGN PATENT DOCUMENTS

DE 19959591 A1 6/2000
DE 20109056 U1 10/2001
(Continued)

*Primary Examiner* — Jerry Redman
(74) *Attorney, Agent, or Firm* — Lucas & Mercanti, LLP

(57) ABSTRACT

Fall arrester (1) for a cable holding device (2) which can be installed without a roof penetration, which cable holding device has at least one post (2*a*), wherein the fall arrester (1) has multiple layers at least in one section of the fall arrester and a post stabilizer (4) and/or a post anchorage (5) is integrated into the multi-layer section (3), wherein the post stabilizer (4) and/or the post anchorage (5) has multiple layers at least in one section thereof, and wherein the multi-layer section (3) of the fall arrester (1) has at least one layer (3*a*) made of composite material reinforced with glass fibers and/or with carbon fibers (FRP layer), and said FRP layer (3*a*) also forms a layer of the multi-layer post stabilizer (4) and/or of the multi-layer post anchorage (5). Furthermore, an at least partially multi-layer post stabilizer (4) which comprises at least one layer (3*a*) made of a composite material (FRP layer) which is reinforced by glass fibers and/or by carbon fibers and a fall protection device which is constructed of several cable holding devices and a fall protection system constructed of several fall protection devices respectively.

15 Claims, 16 Drawing Sheets

(51) Int. Cl.
*A62B 35/04* (2006.01)
*E04G 21/32* (2006.01)

(58) Field of Classification Search
USPC ..... 182/45
See application file for complete search history.

(56) References Cited

U.S. PATENT DOCUMENTS 6,786,020 B2 * 9/2004 Poldmaa ..... A62B 35/0068 182/45
8,025,125 B2 * 9/2011 Vetesnik ..... A62B 1/04 182/3
8,261,878 B2 * 9/2012 Grome ..... E04H 7/065 182/9
8,894,329 B1 * 11/2014 Kekahuna ..... F16B 13/066 405/259.3
2002/0017427 A1 * 2/2002 Guenette ..... A62B 1/08 182/3
2005/0169735 A1 * 8/2005 Pelsue ..... A62B 1/04 414/469
2005/0269154 A1 * 12/2005 Siemienowicz ..... A62B 1/04 182/3
2006/0273600 A1 * 12/2006 Rohlf ..... A62B 35/0068 248/683
2007/0163835 A1 7/2007 Mastenbroek
2010/0243837 A1 * 9/2010 Cox ..... A62B 1/04 248/237
2011/0005150 A1 1/2011 Berlee et al.

FOREIGN PATENT DOCUMENTS

DE 10318322 B3 11/2004
DE 10333113 B3 11/2004
DE 102006054408 A1 6/2008
DE 602004010846 T2 12/2008
DE 102008012232 A1 9/2009
EP 1690567 A2 8/2006
EP 2216466 A1 8/2010
EP 2279031 B1 12/2012
GB 2347725 A 9/2000
GB 2354052 A 3/2001
WO 2005061818 A1 7/2005
WO 2007089139 A2 8/2007

* cited by examiner

FALL ARRESTER HAVING DAMPING, AND DAMPING ELEMENTS FOR A FALL PROTECTION DEVICE

The present application is a 371 of International application PCT/DE2014/000073, filed Feb. 21, 2014, which claims priority of DE 10 2013 002 971.6, filed Feb. 22, 2013, the priority of these applications is hereby claimed and these applications are incorporated herein by reference.

BACKGROUND OF THE INVENTION

The invention relates to a fall arrester having damping and damping element for a fall protection device which can be installed by use of fixation means which do not penetrate the roof as well as a fall protection device which comprises several fall protectors which are connected with a fall arrester respectively.

Fall arrester and fall protection systems serve for the safeguard of persons which work on roofs and other higher arranged regions. At roofs which are entered only for installation and maintenance works or for the purpose of green covering of the roof mostly permanent handrails are relinquished and a fall arrester is installed. Due to security reasons the people who work on a roof without handrails must be secured by means of a cable which is fixed at a fall arrester.

At the installation of a fall arrester on a flat roof it is preferably done without fixation means and fixation points which penetrate the roof surface and its isolation layers. The omission of fixation points which penetrate the roof construction has the big advantage that the single layers of the roof construction are not influenced. Thus, the installation of the fall arrester does not influence the impermeability of the roof. In the case of a fall the fall arresters should minimise the distance of the free fall and the fall of the secured person should be damped as far as possible.

From the state of the art different fall arresters are known which can be installed and which does not penetrate the roof, i. e. fall arresters which can be installed without employment of fixation means which penetrate the roof construction.

For roofs with roof load document DE 201 09 056 U1 discloses a installable fall arrester without penetrating the roof which consists of a plane rest with a texture structure (resting surface) as well as loops which are fixed at the resting surface. The fall arrester is positioned above the roof tightening plane and is charged by the green covering construction, wherein the loops are guided upwards for the fixation of the securing cable through the green covering construction.

The utility model HU 3070U relates to a fall arrester with lightning protection function which can be installed without penetration of the roof. The holders of the fall arrester consist of a respective rest area which is arranged in a plane as well as a post which is guided vertically upwards. Above the rest area of each fall arrester holder a load receiving layer is arranged. The load receiving layer is charged by a load so that depending from the weight of the load the sliding movement of the fall arrester is hindered. For example, the load can consist of a multi-layer green covering construction.

For obtaining an optimised damping the holder of the fall arrester as known from HU 3070U consists essentially respectively of a one-piece steel profile which is at first formed to an arch with circular or polygonal form which is arranged in a plane, wherein the round steel is guided still prior the final integration of the arch in radial direction to the centre point of the arch and from the centre point perpendicular in vertical direction. The vertical section has a fixation element at the upper end section for the fixation of a securing cable. With a respective grounding such a fall arrester holder can also serve as a lightening protection device. This applies especially for a fall arrester system consisting of several of the aforesaid holders which are connected with another by an electrically conductive wire rope.

Document DE 103 33 113 A1 discloses a fall arrester which can be installed without penetration of the roof for roofs with roof load which comprise a resting surface and a post which is connected with the same and which projects beyond a surface of the restring surface, wherein the post comprises a fixation element in a section which is remote from the resting surface and projecting beyond the roof load for securing of a falling load which it to be protected against falling. The fall arrester comprises a load receiving layer which is dedicated as a basis for at least a part of the roof load. The load receiving layer is connected with the resting surface so that in the region of the resting surface a multi-layer construction is created. The load receiving layer which projects laterally beyond the resting surface is dimensioned in such a manner that the fall arrester which is charged with the roof load holds the falling load which acts at the fixation element. The load receiving layer can form one of the layers of the multi-layer green covering of the roof.

To avoid that the part of the plate which is remote from the fall load is not or only reduced lifted from the ground the post which belongs to the fall arrester known from DE 103 33 113 A1 is not rigid but comprises a hinge or a spring. Alternatively, the post and the fixation element which is provided for the fixation of the securing cable can be respectively designed in such a manner that the same show a visible deformation after charging by the fall load and so effect a damping load initiation. The damping of a fall is also effected by a certain displacement (compare paragraph 14) of the fall arrester in the direction of the falling load.

At the device as disclosed in DE 103 33 113 A1 the post is connected with the base plate by a post receiving element (compare FIG. 6 reference numeral 36) or by a thread (compare FIG. 10 reference numeral 30), wherein the post is not stabilised in both cases by additional means in the region of its surface shell. The base plate can comprise an upper and a bottom part, wherein the load receiving layer is arranged between both so that limited to the region of the base plate a multi-layer construction is given.

The post, the fixation element or the base plate with which the post is connected can consist at the fall arrester as known from DE 103 33 113 A1 of every weather-proof material which withstands the relevant strain. Preferably the mention parts consist of metal. Only in case that the post should be deformable glass fiber reinforced plastic of hard rubber is proposed as the material for the post. Plane glass fiber reinforced material which forms a part of the load receiving layer and/or of the base plate is not disclosed in DE 103 33 113 A1. The device and its parts respectively as disclosed in DE 103 33 113 A1 comprise also no predetermined breaking points.

A safety device is known from DE 60 2004 010846 T2 (=EP 1 803 871 A2) which consist of a slack rag and two flange-like parts. The flange-like parts which serve as stand area of the device lay upper-side and bottom-side at the slack rag which serves as ballast receiving element and thus have a multi-layer construction in the region of the base plate. The flange-like parts are connected by fixation means. The fixation means for the fixation of the securing cable comprises an eye at the upper side or is connected with a post. However, the post is not stabilised by the flange-like parts in the region of its surface shell. At a preferred embodiment the two flange-like parts as disclosed in DE 60 2004 010846 T2 comprise insections and perforations which cause a plastic deformation of the flange-like parts in the case of a fall and thereby can damp a fall. Plane glass fiber reinforced material which form a part of the load receiving layer and/or the base plate is not disclosed in DE 60 2004 010846 T2.

Further fall arresters which can be installed without penetration of the roof are known from EP 2 279 031 B1 and WO 2007/089139 A2 as well as from US 2011/0005150 A1, DE 10 2006 054 408 A1 and EP 1 690 567 A2.

At the above mentioned fall arresters which can be installed without penetration of the roof a limited spatial displacement of the fall arrester is admissible in the case of a fall in line with security guidelines. The limited spatial displacement can be understood as controlled sliding movement, wherein beneficially the sliding movement effects a damping of the fall and thereby beneficially reduces the stress in the single parts as well as the stress in the securing cable and the securing gear as well as the loads which act onto the falling person.

From document DE 10 2008 012 232 A1 is the use of the fall arrester is known as described in HU 3070U in connection with portable ballast element as a transportable fall arrester. At this transportable fall arrester the rest area of the respective fall arrester holder is not charged by the bulk good which belongs to the green covering of the roof but by several ballast elements which are connected with the fall arrester during the use of the fall arrester, i. e. temporarily.

At the transportable fall arrest as disclosed in DE 10 2008 012 232 A1 it is provided that section of the fall arrester which is running in vertical direction is at least partially surrounded by an elastic material in the region or section which is surrounded by the ballast elements. The material which consists preferably of a cylindrical rubber section causes an additional damping in the case of stress and should prevent a perpendicular bending of the holding of the cable in the region of the upper edge of the ballast elements. Instead by the rubber section a rather rounded bending of the section of the fall arrester which runs in vertical direction is obtained. Detrimentally, the elastic material which functions as bending protection and which surrounds partially the vertical running post section of the fall arrester creates no relevant damping effect in the case of a fall. As known from the other fall arresters as known from the state of the art the damping is caused at the fall arrester as known from DE 10 2008 012 232 A1 in the case of a fall only by the deformation of the helical bended post in the region of the rest area and by the limited displacement (controlled sliding movement) of the whole fall arrester which is charged by ballast elements.

However, the pre-known fall arresters which can be mounted without penetration of the roof have no additional measures for the damping of a fall which fall arresters are suitable to carry out a controlled sliding movement beside the respective deformable posts or holders of the cable.

Already different technical measures for the damping of falls are known from the technical field of the fall arresters which can be mounted with penetration of the roof (i. e. fall arresters which are firmly connected with the roof construction).

So, EP 2 216 466 A1 discloses a device which is firmly connected with the roof and which can be installed by penetration of the roof at which a deformable section made of sheet metal can be integrated in the socle area (compare FIG. 22). The deformable section surrounds the post which runs upwards in the region of its surface shell and causes in the case of a fall an additional stabilisation of the post. EP 2 216 466 A1 does not disclose a plane glass fiber reinforced material which forms a part of the load receiving layer and thereby contributes for an improvement of the post anchorage and/or causes a stabilisation of the post.

DE 103 18 322 B2 discloses a fall arrester (stop point) which consists of a base plate and a post (holding rod) with attachment eye which is connected with the same. The stop point is firmly connected with the roof by the base plate (i. e. not free from a penetration of the roof). The surface shell of the post is surrounded by a plastically deformable sleeve. The sleeve causes that the post is not deformed already by the preload of the securing cables and that no undesired increase of the force takes place at a fall of a person in the securing cable. EP 2 216 466 A1 does not disclose a plane glass fiber reinforced material which forms a part of the load receiving layer and thereby contributes for an improvement of the post anchorage and/or causes a stabilisation of the post.

GB 2 354 052 A discloses a stop point for a fall arrester. Each stop point is connected with the roof not free from a penetration of the roof by a fixation means (bolt) and comprises an elastomere element for the damping in the case of a fall which surrounds at least partially the surface shell of the post. GB 2 354 052 A does not disclose a plane glass fiber reinforced material which forms a part of the load receiving layer and thereby contributes for an improvement of the post anchorage and/or causes a stabilisation of the post.

None of the above mentioned documents of the state of the art discloses the improved damping properties of plane glass fiber reinforced material as a part of multi-layer fall arrester with post anchorage or a fall arrester with a post stabiliser.

Specifically, none of the documents discloses a multi-layer ballast element which corresponds concerning the design and the function to the fall arrester according to the invention, wherein at least one of the layers of the fall arrester consists of a glass fiber and/or carbon fiber reinforced composite material (FRP layer). Accordingly, the mentioned document does also not disclose the technical advantages which result when the single layer of a multi-layer construction are connected with another laminate-like at least in sections or when the single layers of the multi-layer section are enclosed by an outer cover consisting of FRP material.

SUMMARY OF THE INVENTION

Before this background it is the object of the invention to provide additional damping elements for a cable holding device, wherein the cable holding device can be employed alone or in combination with several similar cable holding devices as fall arresters to be installed without penetrating the roof and which have improved damping properties. Especially, it is an object of the invention to provide additional damping elements for a cable holding device which comprise at least one stand element (resting element) laying in a plane and a vertical deformable post which is fixed at the upper side of the stand element as well as providing of additional damping elements in a stand element (resting element) which serves as post anchorage.

The object is solved by a multi-layer fall arrester according to claim 1, i. e. by a fall arrester which comprises a post anchorage and/or a post stabiliser. Furthermore, the object is solved by a post stabiliser according to the invention which can be used as an additional damping element in combination with a conventional fall arrester which comprises at least one stand element (rest area) laying in the plane and a vertical post which is fixed at the upper side of the stand element.

Accordingly, in the meaning of the invention an "additional damping element" is a multi-layer fall arrest with post stabiliser as well as a multi-layer fall arrester with post anchorage as well as a post stabiliser.

The core idea of the invention is the at least partially designed multi-layer structure of said damping elements, wherein at least one of the layers consists of composite material which is reinforced by glass fibers and/or carbon fibers (FRP layer) and the single layers of the multi-layer section are connected with another least partially laminate-like together or are connected with another by an outer shell made from FRP material. Furthermore, the core idea is the integration of a post stabiliser and/or of a post anchorage in the multi-layer section of the fall arrester, wherein the fall arrester has the addition function of an enlarged resting area and the function of a load receiving layer respectively.

The pre-known fall arresters which can be installed without penetration of the roof show, with respect to the inner design of the resting area and the inner design of the load receiving layer respectively, no measures and features which could cause an additional damping of a fall.

In contrast to that the present fall arrester causes an additional damping in the case of a fall due to its at least partial multi-layer structure in combination with the post stabiliser which is integrated in the multi-layer structure of the fall arrester and in connection with the post anchorage which is integrated in the multi-layer structure of the fall arrester respectively.

The additional damping is caused because the multi-layer designed sections of the additional damping elements have respectively changed deformation properties compared with a single-layer material.

The modification of the deformation properties of the fall arrester can be varied also thereby that in the inner of the multi-layer designed fall arrester sections different materials are combined (e. g. rubber, sheet metals, with glass fibers reinforced materials).

Alternatively, the modification of the deformation properties of the fall arrester can be varied thereby that the layers are connected with another at least partially and/or at least in sections laminate-like. A further kind of the connection of the layers can also be obtained by an outer casing. Specifically, as a casing and a framing respectively of the multi-layer fall arrester sections by an upper and a lower layer have been proven materials which are reinforced by glass fibers (FRP materials) which can be strengthened by addition of a curing polymer.

The displacement of the layers in the inner of the multi-layer designed sections is hindered by the cured FRP shell so that in that manner a variation of the damping properties of the respective multi-layer constructed damping elements can be reached.

So, the multi-layer structure of the fall arrester has different aspects and advantages. At first the multi-layer design allows the integration of a post stabiliser and/or of a post anchorage in the multi-layer section of the fall arrester. On the other hand the multi-layer design causes an improved damping of the cable holding device which is used in combination with the fall arrester in the case of a fall because at least the inner layers of the multi-layer region are arranged in such a manner that they can move relatively to another in the case of a fall and thus cause a damping.

The two other damping element according to the invention, i. e. the post stabiliser and the post anchorage, which can also show a multi-layer design optionally are integrated in the at least sectional multi-layer fall arrester.

"Integrated" in the meaning of the invention means that the fall arrester, especially the multi-layer section of the fall arrester, is connected with the post stabiliser in the region of its bottom end section (socle region) and respectively that the fall arrester, especially the multi-layer section of the fall arrester, is connected with the post anchorage.

A fixed, i. e. not releasable, connection is preferred which is produced in that respective projecting section of the fall arrester are connected with projecting sections of the post stabiliser and the post anchorage respectively by glueing, laminating or by mechanical fixation means. A common layer made of FRP material is specifically preferred because this material improves specifically the damping in the case of a fall.

Thus, the advantage of the additional damping elements according to the invention is in total that their use causes a substantially improved damping of a fall in connection with a cable holding device consisting of post and stand element (resting area) in the case of a fall.

The post which belongs to the cable holding device can be designed as one piece and so merge in the helical bended stand element as disclosed in HU 3070 U or in DE 10 2008 012 232 A1. Alternatively, the post can also be of multi part design and can be connected with a plane plate which serves as stand element.

Furthermore, a post which comprises no stand element can be connected by a counter nut with a post adapter which also serves as stand element. Instead of the counter nut 2*e* also a thread can be machined in the post adapter or a nut can be integrated in a multi-layer post adapter made of FRP material so that the post can be fixed at the post adapter without counter nut.

Due to security reasons a fall arrester must be newly positioned in the case even if it has carried out only a marginal movement. Normally, that means that the layers of the roof structure must be build up completely new at least in the region of the respective fall arrester holders which have been moved under the load of the fall. However, the expenditure for a sectional new arrangement of a green covering of the roof is often as high as a completely new installation of the green covering of the roof. Thus, it is beneficial only due to cost reasons when a displacement of the fall arrester can be avoided.

In the ideal case it even can be reached by the use of the damping elements according to the invention that the parts which belong to the cable holding device in the case of a fall are not displaced with respect to the roof surface, i. e. the energy which becomes free during a fall is completely received by the additional damping elements according to the invention and the deformable parts of the fall arrester (deformable post and deformable cable holding).

However, in every case it is reached by the use of the damping elements according to the invention that the length of the sliding movement, which carries out a fall arrester which is equipped with one or more of the damping elements for the damping of the fall energy, does not exceed a distance of 1.00 m. So the requirements of the standard EN 795 are fulfilled by a fall protection which is equipped with one of the damping elements according to the invention, especially a fall protection which is equipped with the fall arrester according to the invention.

In a preferred embodiment it is provided that beside the fall arrester also the post stabiliser and/or the post anchorage are at least partially designed in a multi-layer manner.

The multi-layer design of the post stabiliser and/or post anchorage which is additionally provided at the preferred embodiment allows the variation of the kinds of connection between the two mentioned damping components and the fall arrester. The overlapping arrangement of the layers in combination with connection means acting laminar between the layers (glue) and/or technical fixation means (e. g. screws or rivets) which penetrate several layers and so connect with another define the stability of the respective connection in a wide range. Thereby, it is the core idea of the invention that the damping properties of the fall arrester can be varied overall by the variation of the stability of the connection in the region of the multi-layer designed parts.

In a specifically preferred embodiment the multi-layer section of the fall arrester comprises at least one layer of a composite material which is reinforced by glass fibers and/or carbon fibers, wherein the composite layer forms a common layer of the multi-layer post stabiliser and/or the multi-layer post anchorage.

In the multi-layer design of the fall arrester, of the post stabiliser as well as of the post anchorage the use of composite material plays an important role which is reinforced by glass fibers (FRP) and/or carbon fibers (CRP) or by other suitable fibers. But also materials from fiber concrete or perforated sheet metals (perforated plates) are usable for the at least partial construction of the fall arrester, of the post stabiliser as well as of the post anchorage.

Composite materials made from plastic which is reinforced by glass fibers (FRP) which are here called FRP materials show a high stability at a low weight. Hardening polymers are used for the stabilisation of fiber mats (glass fiber mats). The common resins, e. g. epoxy resin, polyester resin, silicon resin, are known to the man skilled in the art in their properties and in their application.

The stability of the FRP materials can be strongly influenced only by the arrangement of the layer within the in total multi-layer FRP material. A very high stability is obtained at a continuous overlapping arrangement of the glass fiber layers. However, at an abutting arrangement of single layers the stability of the layers is reduced which layers are arranged in a plurality abutting or at least partially overlapping.

In a specifically preferred embodiment of the fall arrester the FRP layer extends at the upper surface of the fall arrester beyond the edge of the fall arrester and rest at least on a part of the area of the upper side of additional ballast receiving elements which serve for an enlargement of the area of the fall arrester.

An enlargement of the fall arrester area can be obtained in total by the full facing rest, i. e. which extends along the total surface, of the of the FRP layer on the additional ballast receiving element (which FRP layer can itself be a multi-layer arrangement, i. e. which comprises a plurality of single FRP layers).

A significant aspect of the invention relates to the design of a post stabiliser which is provided for the use in combination with a usual cable holding device. Known cable holding devices consist at least of a vertical post which is connected with a stand element which is arranged in the plane. Accordingly, the post stabiliser according to the invention which is put from above onto the cable holding device comprises in the region of its upper side an upper aperture and in the region of its lower side a lower aperture for the reception of the post. Preferably, the post stabiliser surrounds the surface shell of the post at least partially and extends in vertical direction at least up to one third of the total height of the post.

Beneficially, the stabilising effect which is created by the post stabiliser it obtained in that the post stabiliser which is put from above onto the post surrounds the surface shell of the post at least partially and surrounds the post at least up to one third, but preferably at least up to the half of its total height. The post stabiliser lies at least with its upper end section directly at the post and stabilises thereby the same.

In a preferred embodiment the post stabiliser which is integrated into the fall arrester is designed as post cover, wherein the post cover has the shape of a cone or of a hemisphere.

The two preferred forms are distinguished in that the respectively lower aperture which is arranged in the region of the lower side has a larger diameter than the upper aperture which is arranged in the region of the upper side. Thereby, a plurality of post stabilisers can be stacked one upon the other and thus can be stored and transported space-saving.

At a specifically preferred embodiment the post cover which is integrated in the fall arrester has at least one layer made of composite material (FRP layer) which is reinforced with glass fibers, wherein the FRP layer forms a continuous layer with the FRP layer of the multi-layer fall arrester.

A specific stability is obtained when the post stabiliser which is designed as post cover comprises at least one layer which consists of a FRP material and forms also a layer of the multi-layer fall arrester. A respective improvement of the stability of the connection between the post stabiliser and the fall arrester is caused by a plurality of such linked layers.

Mostly preferred is an embodiment at which the post cover which is integrated into the fall arrester comprises a socle which lies in the plane, wherein the socle which is connected with the fall arrester has an at least three-layer design and the respective upper layer and lower layer of the socle consists of a composite material (FRP layer) which is reinforced with glass fibers.

The last least three-layer design is characterized in that as the upper and as the lower layer respectively a FRP layer is provided. The two mentioned FRP layers cause after the curing of the precipitation hardening polymer, which is applied in line with the production of the post cover onto the glass fiber mats, a sandwich-like bundling of the intermediate layers.

At a further preferred embodiment the multi-layer socle of the post stabiliser which is connected with the fall arrester comprises beside at least one layer of a composite material (RFP material) which is reinforced with glass fibers additionally at least on layer of a woven or a non-woven fabric and/or
a bendable metal and/or
an elastic polymer.

The sandwich-like design is characterized in that the bendable metal causes a certain stiffness in the socle area while the layer made of the elastic polymer grants the socle area the required elasticity and stiffness which is necessary in the case of a fall. Depending of the strength of the intermediate layers the strength of the upper and lower FRP layer can vary.

At a further preferred embodiment the post stabiliser which is designed as post cover and which is integrated in the fall arrester comprises in the region of the socle a lower reinforcement and/or in the upper end section an upper reinforcement.

The lower reinforcement which is arranged in the socle region and the upper reinforcement which is arranged in the upper end section are connected with another by the surface shell of the post cover. The surface shell of the post cover can be designed relatively thin because the post cover does not rip in the case of a fall due to the upper reinforcement but is pressed downwards by the bending post. The post cover which is pushed together by this movement is stabilised by the lower reinforcement in the region of the socle. At this embodiment, the damping effect of the post cover is thus effected predominantly by the deformation of the FRP material of the surface shell.

A specifically preferred embodiment of the fall arrest relates to the embodiment of the lower reinforcement in the socle area of the post stabiliser which is designed as post cover. This post cover comprises in the region of the socle a lower reinforcement, wherein the reinforcement is formed by

- a sheet metal with central aperture, wherein the edge region of the central aperture is bended upwards or downwards and/or
- a ring which is formed from a metal profile with circular cross section and/or
- a multi-layer ring with circular or polygonal cross section which consists at least partially of a composite material (FRP material) which is reinforced by glass fibers.

The post which is bended in the case of a fall due to the acting forces can easily obtain a cutting effect against its surroundings. Due to the above mentioned alternative possibilities the reinforcement which lies in the socle area causes that the fall arrester is not destroyed by the bending post in the socle region in the case of a fall.

A second substantial aspect of the invention relates to an embodiment of the fall arrest with integrated post anchorage, wherein the fall arrester comprises a central aperture for the reception of a post or of a post adapter which serves as post anchorage and the edge region of the central aperture comprises a reinforcement.

The reinforcement of the post anchorage in the edge region of the central aperture of the fall arrester can be formed by

- a sheet metal with central aperture, wherein the edge region of the central aperture is bended upwards (laid on edge) or downwards and/or
- a ring which is formed from a metal profile with circular cross section and/or
- a multi-layer ring with circular or polygonal cross section which consists at least partially of a composite material (FRP material) which is reinforced by glass fibers, wherein the FRP material is integrated in the multi-layer design of the fall arrester.

The reinforcement of the post anchorage effects the above advantages which are already mentioned above in connection with the reinforcements of the fall arrester.

A further effect of the invention relates the wilful integration of predetermined breaking points in the region of the post stabiliser and/or of the post anchorage. It is provided that the post stabiliser comprises at least one predetermined breaking point and/or the post anchorage comprises at least one predetermined breaking point.

By predetermined breaking points selected regions of the post stabiliser and/or of the post anchorage are willfully weakened, wherein the device nevertheless well bears the static horizontal force of 0.7 kN which is prescribed by the safety regulations. The weakening can apply only single sections or several sections and all components of the post stabiliser or of the post anchorage respectively. So, for example it is possible that the post stabiliser which is designed as post cover is reinforced in the socle area, however comprises a plurality of predetermined breaking points in the region of the surface shell as well as at the upper side of the post cover. The predetermined breaking points can be formed either by pre-formed openings or insections or by a weakening of the thickness of the layer. Possible is also a combination of both measures.

Accordingly it is provided at a specifically preferred embodiment that the post stabiliser which is integrated in the fall arrester comprises at least one predetermined breaking point in the region of the upper aperture and/or at least one predetermined breaking point in the region of the surface shell of the post stabiliser and/or at least one predetermined breaking point in the region of the socle which is connected with the fall arrester.

At a specifically preferred embodiment it is provided that the post stabiliser comprises several predetermined breaking points in the region of its surface shell which are arranged in line one above the other.

The predetermined breaking points which are arranged one above the other have the effect of a perforation line. Thereby, the ripping of the post cover along the perforation line by the influence of the bending post can be hindered for example in that the layer thickness of the post cover increases in the direction of the socle. The perforation line causes a controlled course of damping with respect to the location of the damping and the extent of the damping.

In a specifically preferred embodiment the post stabiliser which is designed as post cover has at least one longitudinal aperture which goes out from the central aperture in the region of the upper central aperture as predetermined breaking point.

The longitudinal aperture defines the direction of the controlled ripping of the post cover under the effect of the bending post.

In the embodiment of the above mentioned kind of a fall arrester which is preferred most the post cover has at least three predetermined breaking points in the region of the upper aperture, wherein the predetermined breaking points which are designed as insections or as longitudinal openings are arranged with equal distance to another going out from the central aperture.

The three longitudinal apertures define one of the possible directions of the controlled ripping of the post cover under the effect of the bending post.

In a special embodiment the post stabiliser which is integrated in the fall arrester and the post anchorage which is integrated in the fall arrester respectively comprise in each case a recess at the bottom side. The size of the recess corresponds in each case to the shape and height of the stand element which belongs to the fall arrester.

The recess which is provided for the reception of the post anchorage or for the reception of the stand element is dimensioned in such a manner that the bottom side of the recess has only a very small distance to the upper side of the stand element. Thereby, a contact is given between the stand element and the material at the bottom side of the recess due to the roof load which presses down the socle region of the post stabiliser or of the post anchorage. This contact causes an additional stabilisation of the respective cable holding device.

The embodiments of the fall arrester as described above can preferably comprise two or more overlapping ballast receiving element which are arranged to another with equal distance respectively for the enlargement of the resting area, wherein the ballast receiving element are connected at the upper side and/or at the bottom side at least sectional with composite material (FRP material) which is reinforced with glass fibers which composite material is also an element of the post cover or of the post anchorage.

As the connection between the ballast receiving elements and the fall arrester is respectively flexible the ballast receiving elements can be flapped space-saving downwards or upwards during the transport of the stackable fall arresters with semicircular or cone-shaped cross section.

An additional aspect of the invention relates to the above explained post stabiliser in connection with the fall arrester as such, because the post stabiliser can also be used independently.

The above mentioned aspects and advantages with respect to the post stabiliser and the post stabiliser which is designed as post cover respectively apply also for the post stabiliser according to the invention as such. This applies for the damping properties which have been explained in connection with the multi-layer arrangement of the post stabiliser as well as for the predetermined breaking points which are explained in connection with the post stabiliser.

Only due to those beneficial properties the at least also partially multi-layer designed post stabiliser needs not necessarily be used in connection with a multi-layer designed fall arrester but can be used independently.

Thus, the object of the invention is with respect to the post stabiliser as such to provide a damping element for a cable holding device which comprises at least one stand element (resting area) which lies in the plane as well as vertical and deformable post which is fixed at the upper side of the stand element.

The object is solved by a post stabiliser for a cable holding device comprising a post as well as a stand element, wherein the post stabiliser for the reception of the post comprises an upper aperture in the region of its upper side and a lower aperture in the region of its bottom side and wherein the at least partially multi-layer designed post stabiliser surrounds the surface shell of the post at least partially and extends in vertical direction at least up to a third of the total height of the post, wherein at least one of the layers of the multi-layer post cover comprises a composite material which is reinforced by glass fibers (FRP layer).

The beneficial properties of the post stabiliser are also basing on the multi-layer arrangement of the post stabiliser as explained above.

A post stabiliser which is designed as post cover absorbs the required static horizontal force of 0.7 kN and is thus usable with each kind of fall arrester, i. e. the post cover according to the invention is usable as independent damping element.

Beside its function as damping element a post stabiliser which is designed as post cover can also provide a signal function by a painting with a luminous paint or by the installation of lamps (e. g. light emitting diodes (LED)). Also, a scale at the surface shell can mark up to which height the respective single layers should reach which belong to a green covering of the roof.

In a preferred embodiment the post stabiliser is designed as post cover and comprises at least one predetermined breaking point.

In a preferred embodiment the post cover comprises the shape of a cone or of a hemisphere, wherein each at least one predetermined breaking point is arranged in the region of the upper aperture and/or in the region of the surface shell of the post stabiliser and/or in the region of the socle which is connected with the fall arrester.

The predetermined breaking points have beside the damping function also a function of an indicator, i. e. a rip at a predetermined breaking point shows that a fall took place or at least a load similar to a fall occurred.

In a preferred embodiment of the post stabiliser which is designed as post cover at least one of the layers of the multi-layer post cover is a composite material which is reinforced by glass fibers (FRP layer).

Specifically preferred is a three-layer structure in the region of the socle, wherein the respective topmost layer and the lowermost layer of the socle consists of a composite material which is reinforced by glass fibers (FRP layer).

A substantial aspect of the post stabiliser relates to the enlargement of the resting area by additional plane or lapped ballast receiving element.

The enlargement of the resting area is obtained in that the multi-layer socle of the post stabiliser comprises beside at least one layer of composite material which is reinforced by glass fibers (FRP material) additionally at least one layer of a woven or non-woven fabric and/or a bendable metal and/or an elastic polymer.

In a further special embodiment it is provided that the post stabiliser which is designed as post cover comprises in the region of the socle a lower reinforcement and/or in the upper end section an upper reinforcement.

The reinforcement in the region of the socle is preferably formed by a sheet metal with central aperture, wherein the edge region of the central aperture is bended upwards or downwards and/or a ring which is formed from a metal profile with circular cross section and/or a multi-layer ring which consists at least partially of a composite material which is reinforced with glass fibers (FRP material) with ring has a circular or polygonal cross section.

In a further special embodiment the post stabiliser which is designed as post cover has in the region of its surface shell several predetermined breaking points which are arranged in line one above the other and/or in the region of the socle at least one predetermined breaking point and/or in the region of the upper central aperture being the predetermined breaking point a longitudinal opening which goes out from the aperture.

Specifically preferred as post stabiliser is a post cover which comprises at least three predetermined breaking points in the region of the upper aperture, wherein the predetermined breaking points are designed as insections or longitudinal openings which are arranged with respective equal distance, i. e. star-shaped, going out from the central aperture.

The aspects and specific features which relate to the post stabiliser as such exhibit the same features (predetermined breaking points, reinforcements, enlargement of the resting area) which are mentioned above in connection with the fall arrester and have the same effects and advantages as explained.

Subject of the invention is also a fall arrester which is built up of at least one cable holding device which respectively comprises at least a post with a stand element or a post adapter, wherein with each cable holding device a fall arrester with an integrated post stabiliser and/or with an integrated post anchorage according to the above mentioned embodiments is connect in such a manner that the post is guided through the central aperture and in the fall arrester and the fall arrester lies on the stand element or the post adapter.

Likewise a fall securing system is the subject of the invention which system is built up of two or more of the above mentioned fall arresters, wherein the end sections of the post, which belong to the respective fall arrester, are connected at least partially by a cable or by a rail at which a cable is fixed movably.

Also within the frame of the invention is the use of a fall arrester according to the invention or of a post stabiliser according to the invention for the construction of a fall arrester or for the construction of a fall arrester system.

The following clauses summarize the above mentioned basic aspect and advantages as well as the preferred combinations of features of the invention:

1. Fall arrester (1) for a cable holding device (2) which can be installed without a roof penetration which has at least one post (2*a*), wherein the fall arrester (1) has multiple layers at least in sections and that in the multi-layer section (3)
   a post stabiliser (4) and/or
   a post anchorage (5)
   is integrated.
2. Fall arrester (1) for a cable holding device (2) which can be installed without a roof penetration according to clause 1, characterized in that
   the post stabiliser (4) and/or
   the post anchorage (5)
   are multi-layer designed at least in sections.
3. Fall arrester (1) for a cable holding device (2) which can be installed without a roof penetration according to clause 2, characterized in that the multi-layer sections (3) of the fall arrester (1) comprises at least one layer (3*a*) of composite material which is reinforced by glass fibers and/or with carbon fibers (FRP layer) and the FRP layer (3*a*) forms at once a layer
   of the multi-layer post stabiliser (4) and/or
   of the multi-layer post anchorage (5).
4. Fall arrester (1) for a cable holding device (2) which can be installed without a roof penetration according to clause 3, characterized in that the FRP layer (3*a*) rest in full plane or at least in parts of the plane on the upper side of additional ballast receiving element (1*c*, 4*m*) which serve for the enlargement of the area of the fall arrester (1).
5. Fall arrester (1) with integrated post stabiliser (4) according to one of clauses 1 to 4, characterized in that the cable holding device comprises at least
   a post (2*a*) as well as
   a stand element (2*b*)
   and wherein the post stabiliser (4) comprises
   in the region of its upper side an upper aperture (4*b*) and
   in the region of its bottom side a lower aperture (4*c*) for the reception of the post (2*a*).
6. Fall arrester (1) with integrated post stabiliser (4) according to clause 5, characterized in that the post stabiliser (4) surrounds the surface shell of the post (2*a*) at least partially and extends in vertical direction at least up to a third of the total height of the post (2*a*).
7. Fall arrester (1) with integrated post stabiliser (4) according to clause 6, characterized in that the post stabiliser (4) is designed as post cover (4*a*), wherein the post cover (4*a*) has the shape of a cone or of a hemisphere.
8. Fall arrester (1) with integrated post stabiliser (4) according to one of the clauses 5 to 7, characterized in that the post cover (4*a*) comprises at least one layer (4*e*, 4*f*) of composite material which is reinforced by glass fibers (FRP layer), wherein the FRP layer (4*e*, 4*f*) forms a continuous layer with the FRP layer (3*a*) of the multi-layer fall arrester (3).
9. Fall arrester (1) with integrated post stabiliser (4) according to clause 8, characterized in that the post stabiliser (4) which is designed as post cover (4*a*) comprises a socle (4*d*) which lies in the plane, wherein the socle (4*d*) which is connected with the fall arrester (1) comprises an at least three-layer design and the respective uppermost layer (4*e*) and lowermost layer (4*f*) of the socle (4*d*) consist of composite material which is reinforced by glass fibers (FRP layer).
10. Fall arrester (1) with integrated post stabiliser (4) according to clause 9, characterized in that the multi-layer socle (4*d*) of the post stabiliser (4) which is connected with the fall arrester (1) comprises beside at least one layer (4*e*, 4*f*) made of composite material which is reinforced by glass fibers (FRP material) additionally at least one layer of
    a woven or non-woven fabric (4*m*) and/or
    a bendable metal (4*n*) and/or
    an elastic polymer (4*o*).
11. Fall arrester (1) with integrated post stabiliser (4) according to one of clauses 5 to 9, characterized in that the post stabiliser (4) which is designed as post cover (4*a*) comprises in the region of the socle (4*d*) an lower reinforcement (4*g*) and/or in the upper end section an upper reinforcement (4*h*).
12. Fall arrester (1) with integrated post stabiliser (4) according to clause 11, characterized in that the post stabiliser (4) which is designed as post cover (4*a*) comprises in the region of the socle (4*d*) an lower reinforcement (4*h*), wherein the reinforcement (4*h*) is formed by
    a sheet metal with central aperture, wherein the edge region of the central aperture is bended upwards or downwards and/or
    a ring which is formed from a metal profile with circular cross section and/or
    a multi-layer ring with circular or polygonal cross section which consists at least partially of a composite material (FRP material) which is reinforced by glass fibers.
13. Fall arrester (1) with integrated post anchorage (5) according to one of clauses 1 to 4 or fall arrester (1) with integrated post stabiliser (4) according to one of clauses 5 to 12, characterized in that the fall arrester (1) comprises a central aperture (5*a*) which serves as post anchorage (5) for the reception of a post (2*a*) or of a post adapter (2*f*) and the edge region of the central aperture (5*a*) comprises a reinforcement (5*d*).
14. Fall arrester (1) with integrated post anchorage (5) according to clause 13, characterized in that the reinforcement (5*d*) is formed in the edge region of the central aperture (5*a*) by
    a sheet metal with central aperture (5*a*), wherein the edge region of the central aperture (5*a*) is bended upwards (laid on edge) or downwards and/or
    a ring which is formed from a metal profile with circular cross section and/or a multi-layer ring with circular or polygonal cross section which consists at least partially of a composite material (FRP material) which is reinforced by glass fibers, wherein the FRP material is integrated in the multi-layer structure of the fall arrester (1).

15. Fall arrester (1) with integrated post stabiliser (4) according to one of clauses 5 to 12 and/or with integrated post anchorage (5) according to one of clauses 13 to 14, characterized in that the post stabiliser (4) comprises at least one predetermined breaking point (4*i*, 4*j*, 4*k*) and/or the post anchorage (5) comprises at least one predetermined breaking point (5*e*).

16. Fall arrester (1) with integrated post stabiliser (4) according to clause 15, characterized in that the post stabiliser (4) comprises in the region
of the upper aperture (4*b*) at least one predetermined breaking point (4*i*) and/or in the region
of the surface shell of the post stabiliser (4) at least one predetermined breaking point (4*j*) and/or in the region
of the socle (4*d*) which is connected with the fall arrester (1) at least one predetermined breaking point (4*k*).

17. Fall arrester (1) with integrated post stabiliser (4) according to clause 16, characterized in that the post stabiliser (4) comprises in the region of its surface shell several predetermined breaking points (4*j*) which are arranged in line one above the other.

18. Fall arrester (1) with integrated post stabiliser (4) according to one of clauses 15 to 17, characterized in that the post stabiliser (4) comprises in the region of the upper central aperture (4*b*) as a predetermined breaking point (4*i*) at least one longitudinal opening (4*i*) which goes out from the aperture (4*b*).

19. Fall arrester (1) with integrated post stabiliser (4) according to clause 18, characterized in that the post stabiliser (4) comprises in the region of the upper central aperture (4*b*) at least three predetermined breaking points (4*i*), wherein the predetermined breaking points (4*i*) which are designed as insections or as longitudinal openings are arranged with equal distance to another going out from the central aperture (4*b*).

20. Fall arrester (1) with integrated post stabiliser (4) and/or with integrated post anchorage (5) according to one of clauses 1 to 19, characterized in that at the bottom side of the post stabiliser (4) a recess (4*p*) is provided and/or at the bottom side of the post anchorage (5) a recess (5*f*) is provided, wherein the size of the recess (4*p*, 5*f*) corresponds respectively to the shape and height of the stand element (2*b*) or to the shape and height of the stand element of the post adapter (2*f*).

21. Fall arrester (1) with integrated post stabiliser (4) and/or with integrated post anchorage (5) according to one of clauses 1 to 20, characterized in that the fall arrester (1) comprises for the enlargement of its rest area two or more lapped ballast receiving elements (1*c*, 3*f*, 4*m*) which are arranged to another with equal distance, wherein the ballast receiving elements (1*c*, 3*f*, 4*m*) are connected at the upper side and/or at the bottom side at least partially with a composite material which is reinforced with glass fibers (FRP material), which is also part of the post cover (4) or of the post anchorage (5).

22. Post stabiliser (4) for a cable holding device (2) which comprises at least
a post (2*a*) as well as
a stand element (2*b*),
wherein the post stabiliser (4) comprises for the reception of the post (2*a*)
in the region of its upper side an upper aperture (4*b*) and
in the region of its bottom side a lower aperture (4*c*)
and wherein the at least sectional multi-layer constructed post stabiliser (4)
surrounds the surface shell of the post (2*a*) at least partially and
extends in vertical direction at least up to a third of the total height of the post (2*a*).

23. Post stabiliser (4) according to clause 22, characterized in that the post stabilizer (4) is designed as post cover (4*a*), wherein the post stabiliser (4) comprises at least one predetermined breaking point (4*i*, 4*j*, 4*k*).

24. Post stabiliser (4) according to clause 23, characterized in that the post stabilizer (4) is designed as post cover (4*a*), wherein the post cover (4*a*) comprises the shape of a cone or of a hemisphere and comprises in the region of the upper aperture (4*b*) at least one predetermined breaking point (4*i*) and/or in the region of
the surface shell of the post stabilizer (4) at least one predetermined breaking point (4*j*) and/or in the region of
the socle (4*d*) which is connected with the fall arrester (1) has at least one predetermined breaking point (4*k*).

25. Post stabiliser (4) according to one of clauses 22 to 24, characterized in that the post stabilizer (4) is designed as post cover (4*a*), wherein at least one of the layers (4*e*, 4*f*) of the multi-layer post cover (4) comprises a composite material which is reinforced by glass fibers (FRP layer).

26. Post stabilizer (4) according to clause 25, characterized in that the post stabilizer (4) is designed as post cover (4*a*), wherein the multi-layer socle (4*d*) of the post stabiliser (4) which is connected with the fall arrester (1) comprises beside at least one layer (4*e*, 4*f*) made of composite material which is reinforced by glass fibers (FRP material) additionally at least one layer of
a woven or non-woven fabric (4*m*) and/or
a bendable metal (4*n*) and/or
an elastic polymer (4*o*).

27. Post stabiliser (4) according to clause 25, characterized in that the post stabilizer (4) is designed as post cover (4*a*), wherein the post stabilizer (4) which is designed as post cover (4*a*) comprises in the region of the socle (4*d*) a lower reinforcement (4*g*) and/or in the upper end section an upper reinforcement (4*h*).

28. Fall arresting device built up of at least one cable holding device (2) which respectively comprises at least
a post (2*a*) as well as
a stand element (2*b*),
wherein with each cable holding device (2) a fall arrester (1) with integrated post stabilizer (4) and/or with integrated post anchorage (5) is connected according to one of the clauses 1 to 21 in such a manner that the post (2*a*) is guided through the central apertures (4*a*, 4*c*) in the fall arrester and the fall arrester (1) rests on the stand element (2*b*) or on the post adapter (2*f*).

29. Fall arrester system built up of two or more fall arresters according to clause 28, wherein the end sections of the posts (2*a*) which belong to the respective fall arrester device are connected with another at least partially by a cable or by a rail at which a cable is fixed movably.

30. Use of a fall arrester according to one of the clauses 1 to 21 or of a post stabilizer according to one of the clauses 22 to 27 for the setup of a fall arrester device according to clause 28 or for the setup of a fall arrester system according to clause 29.

EXAMPLES

Embodiments, advantages and possible applications of the invention result also from the following description of embodiments and from drawings which illustrate the invention by means of examples without limit the same.

All illustrated and/or depicted features form the subject matter of the invention as such or in any combination independent from its summary in the claims or their reference back.

DETAILED DESCRIPTION OF THE INVENTION

Figure 1:
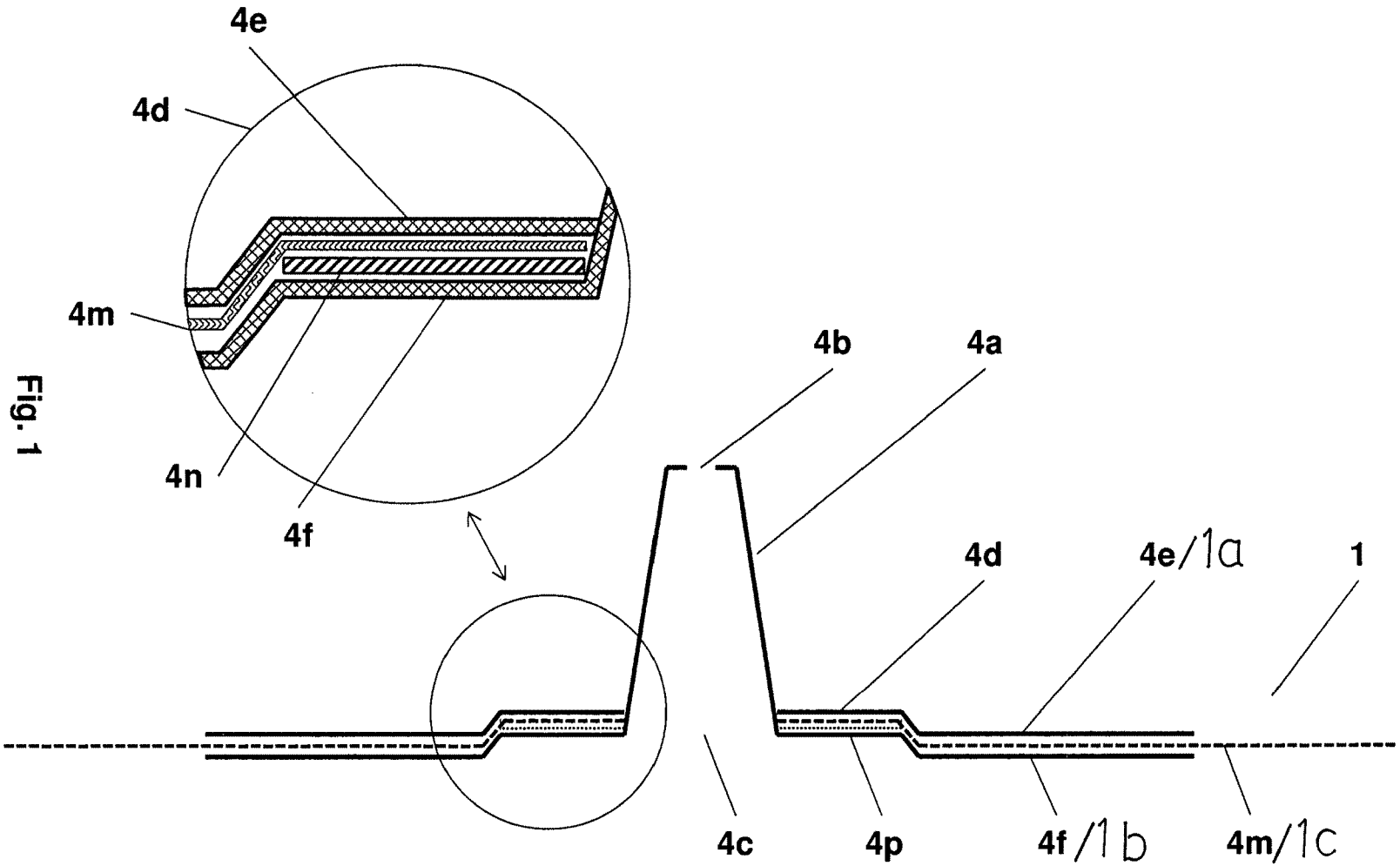
FIG. 1 multi-layer fall arrester with integrated post cover
Figure 7:
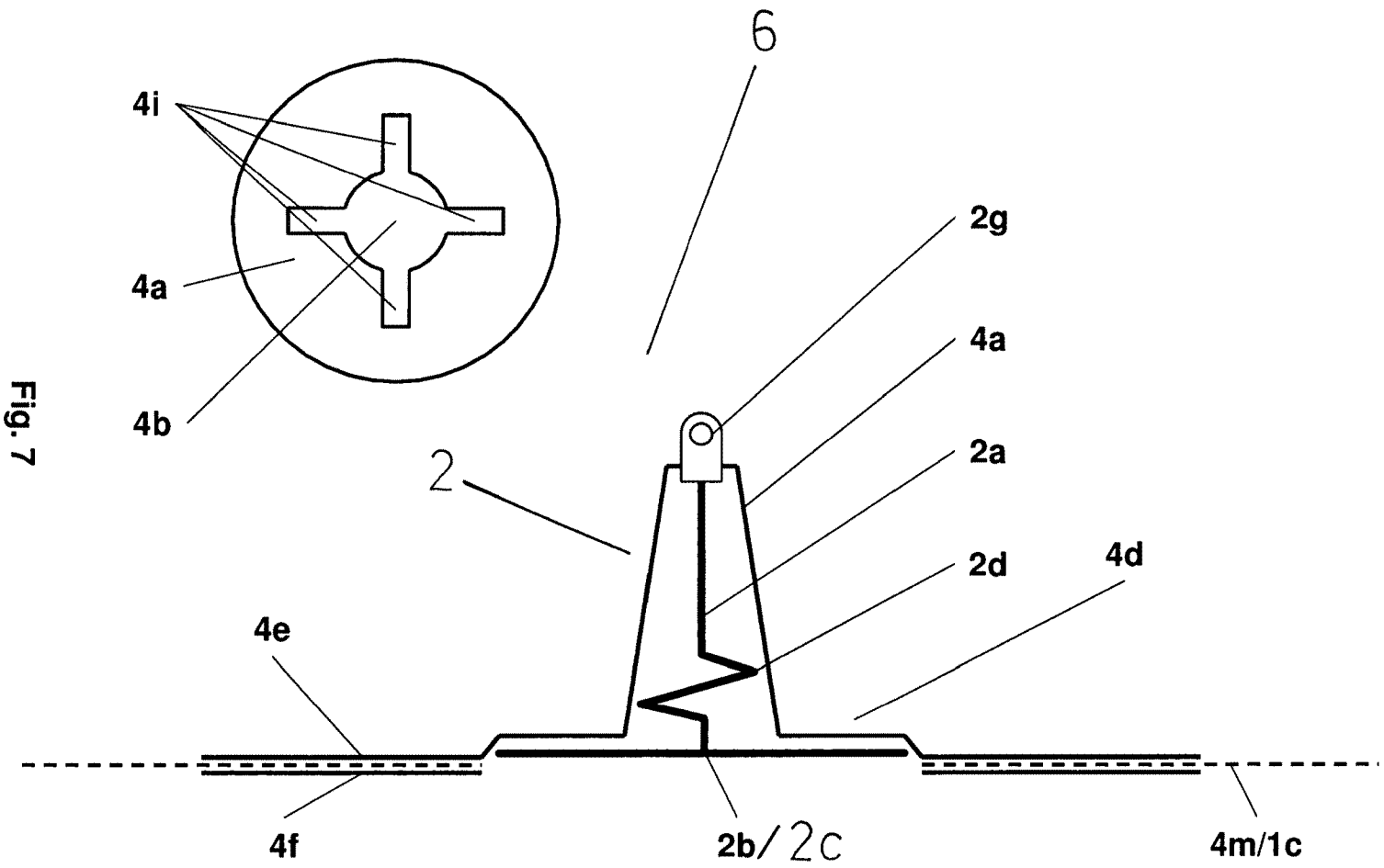
FIG. 7 fall arrester with integrated post cover and a post with helical bended damping section FIG. 8 multi-layer fall arrester with integrated post anchorage and a post adapter which is received by the post anchorage FIG. 9 multi-layer fall arrester with integrated post anchorage for the reception of a post adapter FIG. 10 multi-layer fall arrester with integrated multi-layer post anchorage and a post adapter which is received by the post anchorage FIG. 11 multi-layer fall arrester with post anchorage and a multi-layer post adapter which is integrated in the also multi-layer post anchorage FIG. 12 post cover with cross member which cross itself FIG. 13 fall arrester with a post cover which is reinforced in the socle region and in the upper end section FIG. 14 cone-shaped post cover with predetermined breaking points in the socle region and in the region of the surface shell

FIG. 1 shows a cross section of a cone-shaped post stabiliser 4 which is designed in a multi-layer manner in the socle region 4*d*. The socle region 4*d* is at first characterized in its shape in that it comprises a recess 4*p* in its bottom region which shape and size corresponds of a stand element (not depicted) of a cable holding device which can be inserted into the post stabilizer. Thereby the fall arrester 1 with the integrated cone-shaped post stabiliser 4*a* can be put onto the cable holding device 2 from above (as shown in FIG. 7) without a deformation of the fall arrester 1 takes place in the region which is arranged above the stand element.

The multi-layer design in the socle region 4*d* comprises beside the upper FRP layer 4*e* and the lower FRP layer 4*f* two further layers 4*n*, 4*m*. In the shown example the layer 4*n* consists of a sheet metal and the second layer 4*m* of a woven or non-woven fabric (nonwoven fabric). For the setup of the multi-layer socle 4*d* a discus-shaped disk made of sheet metal 4*n* is put from above onto the cone after the attachment of the lower FRP layer 4*e*. Subsequently, the attachment of the layers 4*m* and 4*e* occurs. The multi-layer design has only due to the cover by the outer FRP layer 4*e* and 4*f*, which encase the multi-layer structure, specific deformation properties.

Figure 2:
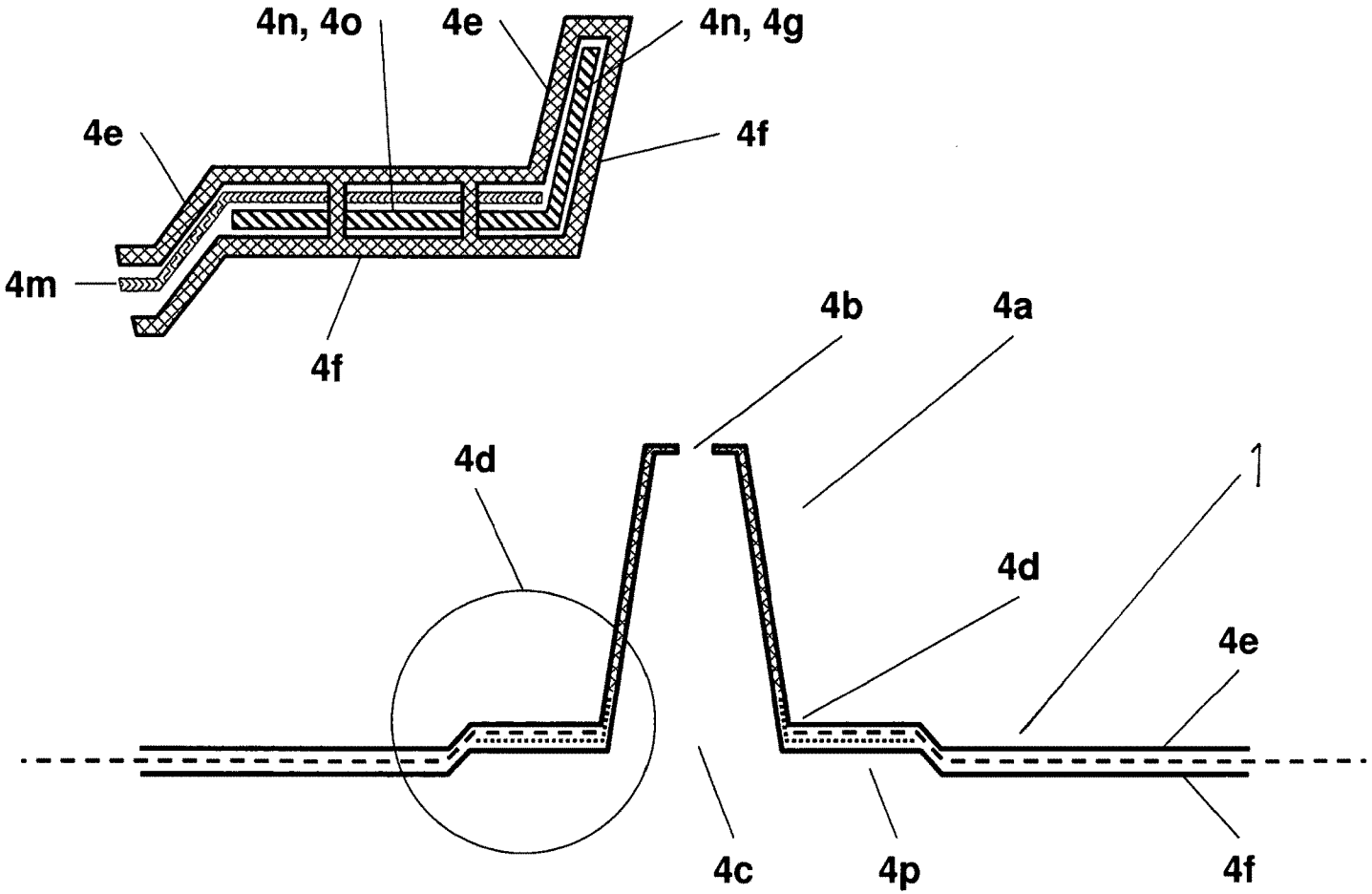
FIG. 2 detailed view of the multi-layer fall arrester with integrated post anchorage and reinforcement in the socle area FIG. 3 cone-shaped post cover as post stabilizer FIG. 4*a* post cover with integrated fall arrester FIG. 4*b* post cover with grid fall arrester which is laid on in the upper side FIG. 4*c* post cover with integrated fall arrester and grid fall arrester which is laid on in the upper side FIG. 5 fall arrester with integrated post cover and reinforcement in the socle area and in the region of the upper side (top plan view)

FIG. 2 shows in detail the layer construction of a post stabilizer 4 which is designed cone-shaped as post cover 4*a*. Between the upper layer 4*e* and the lower layer 4*f* a metal 4*n* is arranged being an additional layer. The metal 4*n* is set on edge in the socle region of the post cover 4*a* and causes thereby a reinforcement 4*g* of the post stabiliser 4 in the bottom region, i. e. in the region of the socle 4*d* of the post cover 4*a*. Alternatively or additionally the layer 4*n* can consist of a polymer 4*o* instead of metal. Beside the metal 4*n* a woven or non-woven fabric 4*m* is integrated between the upper layer 4*e* and the lower layer 4*f*. The lower drawing of FIG. 2 shows the post cover 4*a* in cross section with the upper aperture 4*b* and the lower aperture 4*c* as well as the lower recess 4*p*.

The cone-shaped post stabilizer 4*a* which is integrated in the fall arrester 1 has a multi-layer structure. Thereby, the outer layers, i. e. the upper layer 4*e* and the lower layer 4*f*, consists respectively of a FRP material which also forms the outer and inner side of the cone which belongs to the post stabiliser 4. Simultaneously, the two outer layers 4*e*, 4*f* project in radial direction beyond the socle and form the surface of the fall arrester 1 which adjoins to the socle region 4*d*. I. e. in this section of the fall arrester 1 the load reception layer 4*m* made of woven or non-woven fabric is imbedded sandwich-like by the two outer layers 4*e*, 4*f*.

Figure 3:
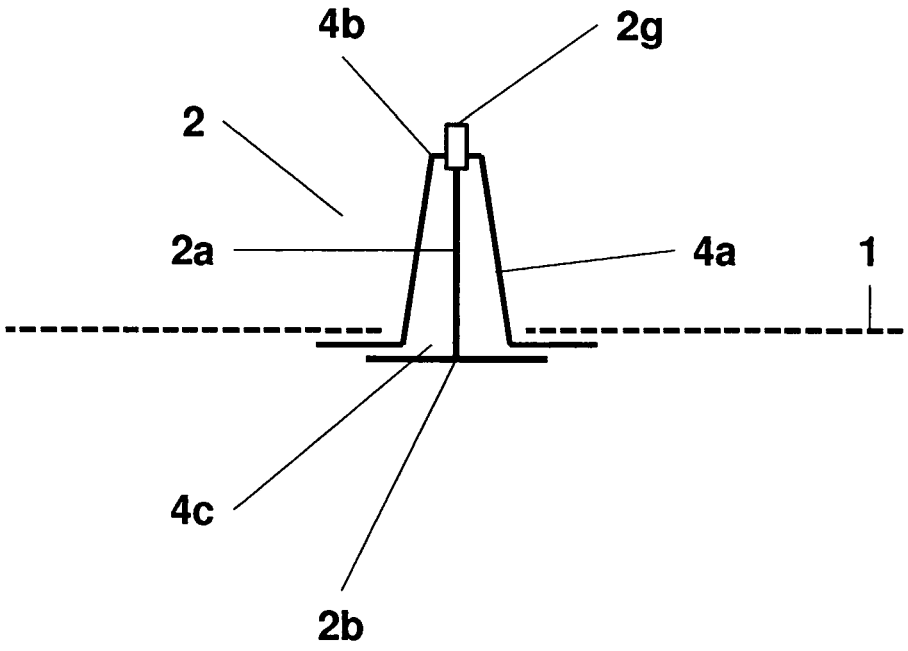

FIG. 3 shows a cone-shaped post stabiliser 4*a* with an upper aperture 4*b* and a lower aperture 4*c*. The upper end of the post with the cable fixation 2*g* projects through the upper aperture 4*b* of the post stabiliser 4. The socle region of the post stabiliser 4 rest onto the upper side of the stand element and loads the same.

Figure 4A:
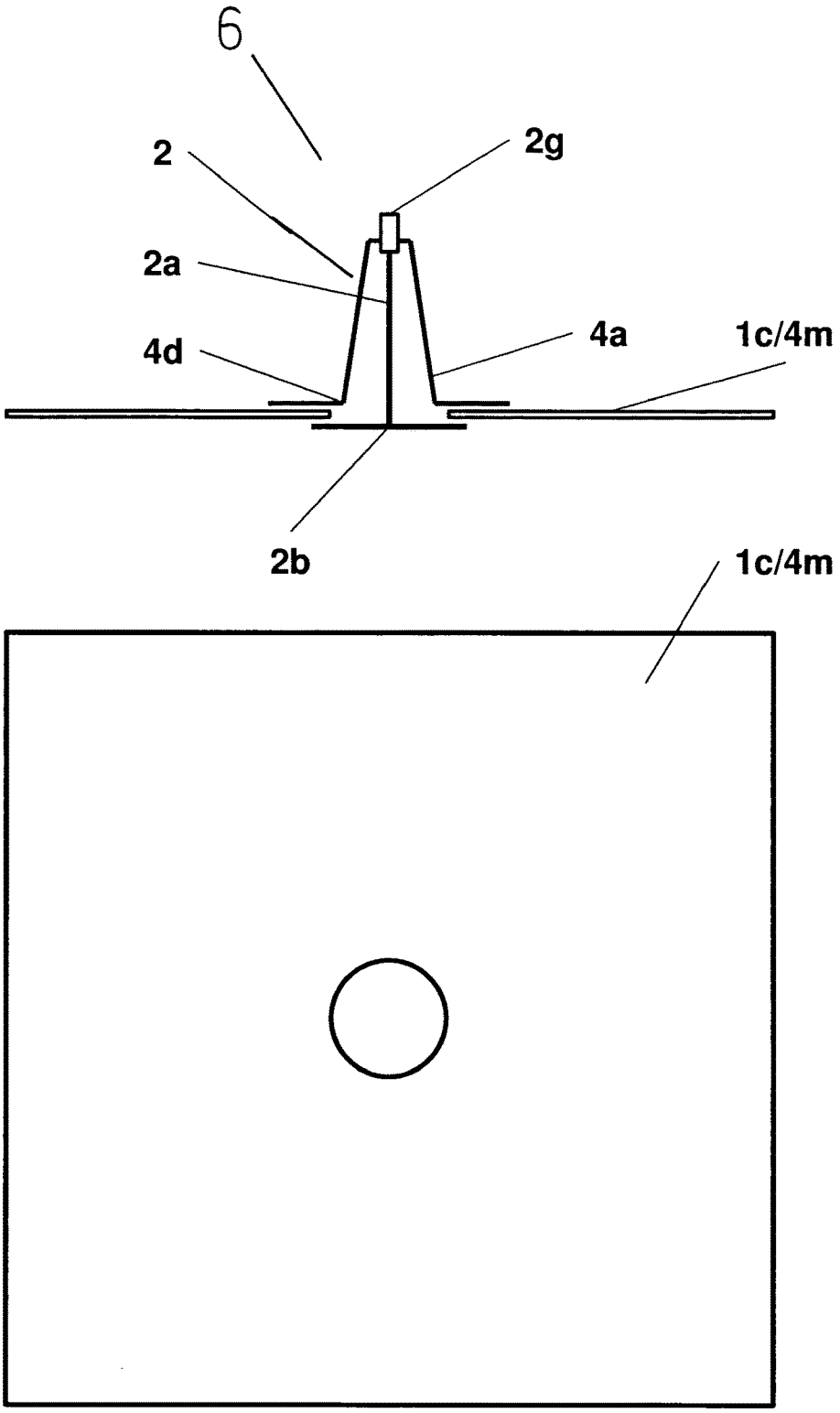

FIG. 4*a* shows in cross section a cable holding device 2 consisting of post and stand element which has at the upper end a cable fixation 2*g*. A plane material, which can consist of a woven or non-woven fabric 1*c*, rests on the stand element 2*b* for the enlargement of the surface.

Specifically preferred as plane material is non-woven fabric. The fall arrester has a central aperture which is provided for the reception of the post. The connection between the cone-shaped post stabiliser 4 and the ballast receiving element 4*m*/1*c* (capture carpet) can also be established as detachable connection by means of screws or rivets. The mentioned components form together the fall arrester device 6.

Figure 4B:
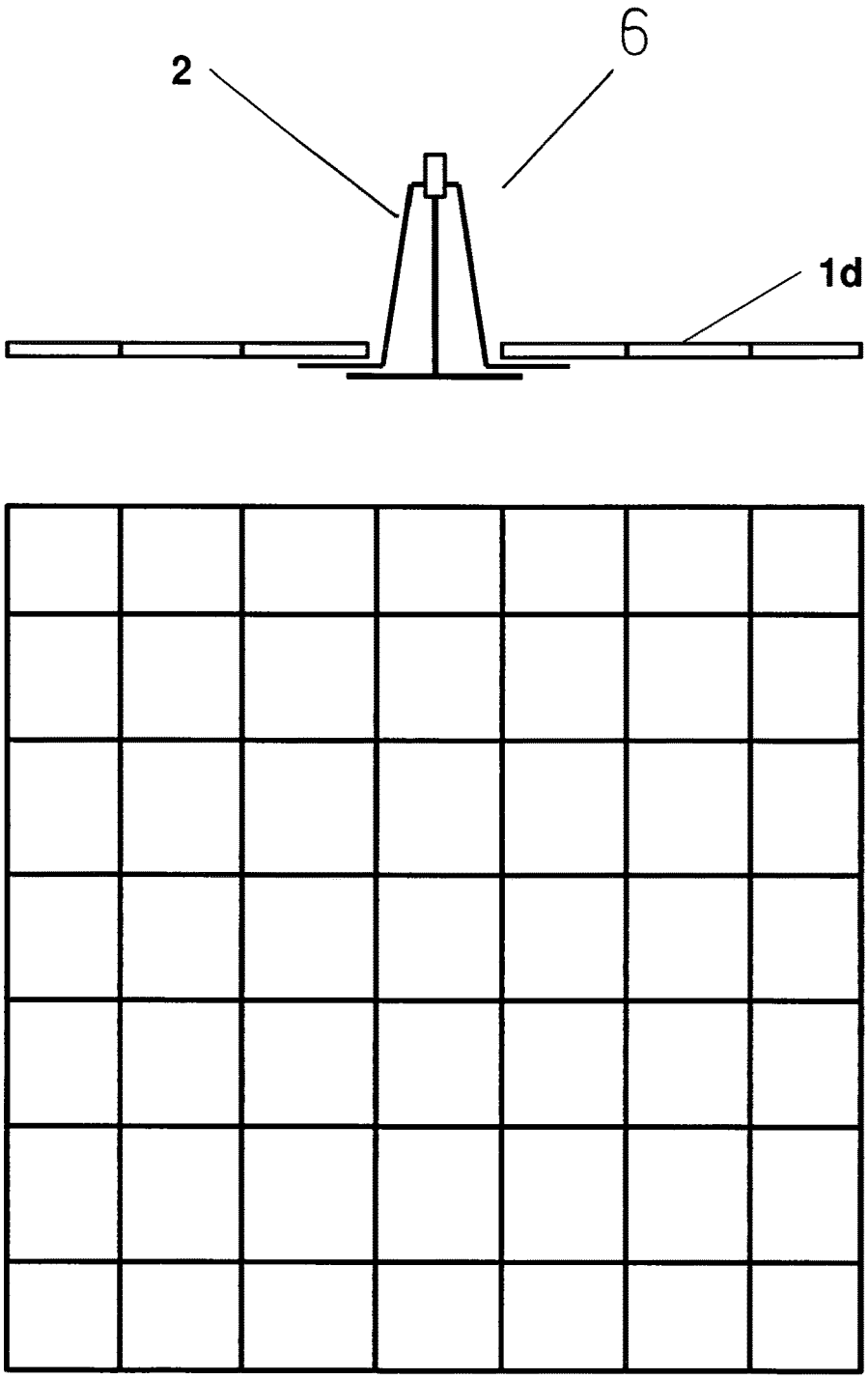

FIG. 4*b* shows an alternative embodiment of the device as shown in FIG. 4*a*. At the embodiment as shown in FIG. 4*b* the fall arrester 1 does not consist of a plane material but of a grid-shaped material 1*d*. The bulk good which is provided for the setup of the green covering of the roof penetrates into the spacing of the grid fall arrester 1*d* and increases thereby the friction resistance of the fall arrester 1 in the case of a fall. The mentioned components form together the fall arrester device 6.

Figure 4C:
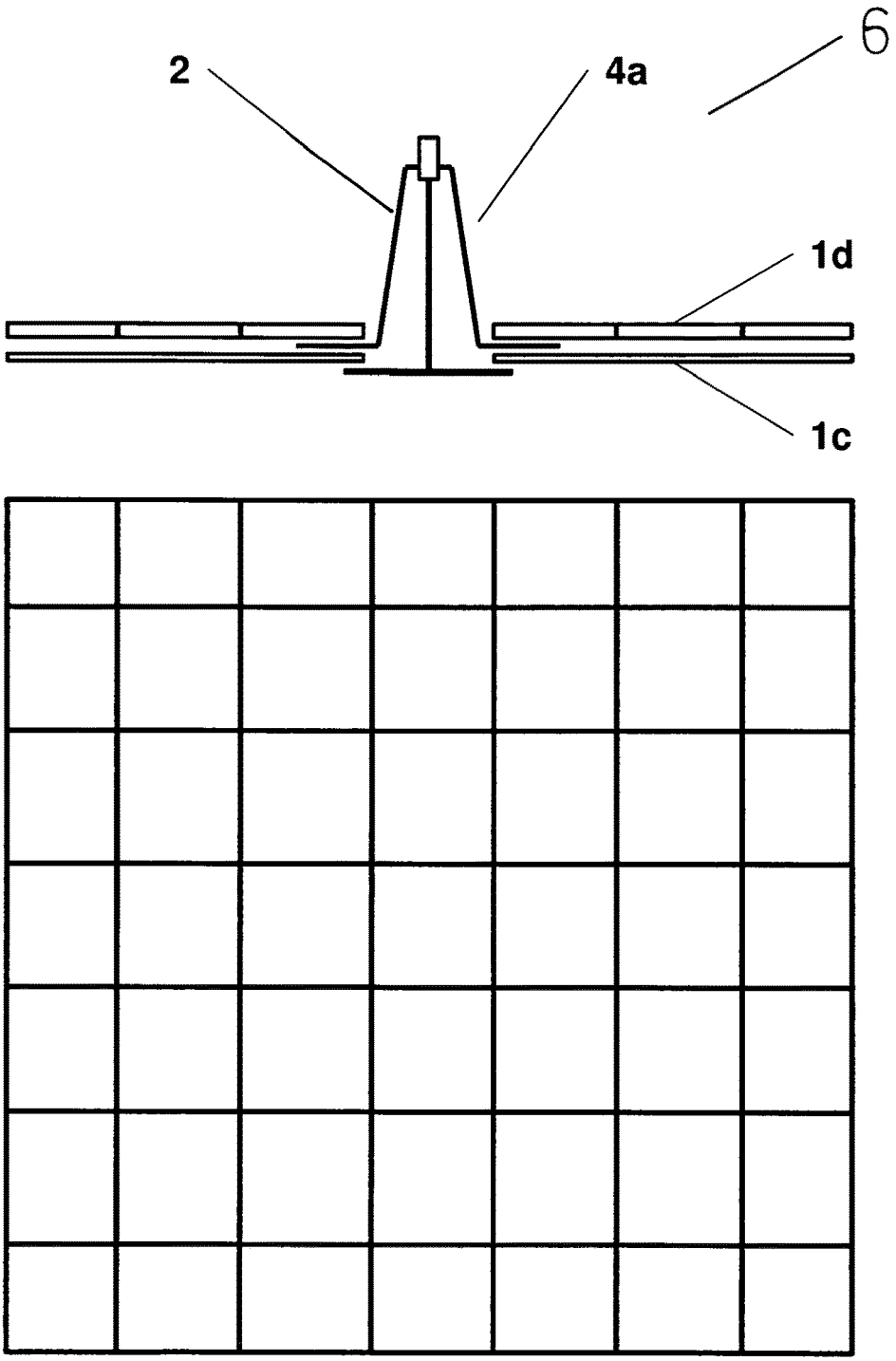

FIG. 4*c* shows an alternative embodiment of the fall arrester device 6 as shown in FIG. 4*b*. The fall arrester device 6 according to FIG. 4*c* is characterized in that additionally a ballast receiving element 1*c* made of a woven or non-woven fabric is connected with the socle 4*d* of the post cover 4*a* beside the grid fall arrester 1*d*.

Figure 5:
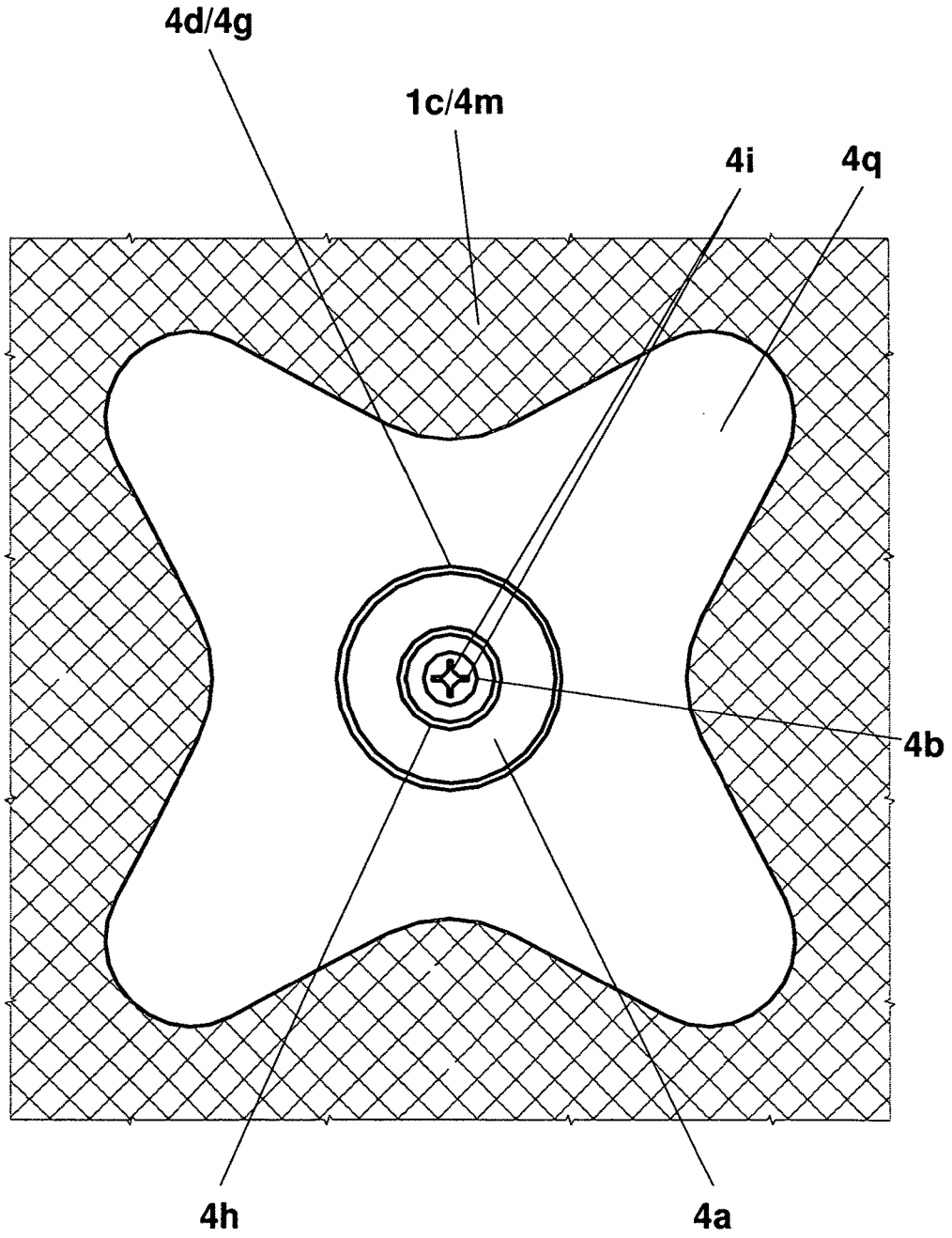

FIG. 5 shows a cone-shaped post stabiliser 4*a* in a top plan view. Its upper side has in total four predetermined breaking points 4*i*, wherein the predetermined breaking points 4*i* which are designed as longitudinal openings go out respectively from the central aperture 4*b*. The longitudinal openings 4*i* allow in the case of a load the controlled ripping of a post in the upper side and in the adjoining surface shell of the post cover 4*a*. The predetermined breaking points 4*i* which are designed in the shape of longitudinal openings are arranged star-shaped to another at equal distance. Thereby the post 2*a* which will bend in the case of a load is guided in the respective next longitudinal opening 4*i*.

Seen in the top plan view the cone-shaped post stabiliser 4*a* comprises in the lower region four rag-like shaped area elements 4*q* made of FRP material. Those area elements 4*q* cause a stabilization of the socle 4*d* and also an enlargement of the resting area so that a post cover 4*a* equipped with the area elements 4*q* is still better fixed by the load of the green covering of the roof. An additional enlargement of the resting area is obtained by the ballast receiving element 4*m*.

The post cover 4*a* comprises in the socle region the reinforcement 4*g*. In the upper end section the post cover 4*a* comprises the upper reinforcement 4*a*.

Figure 6:
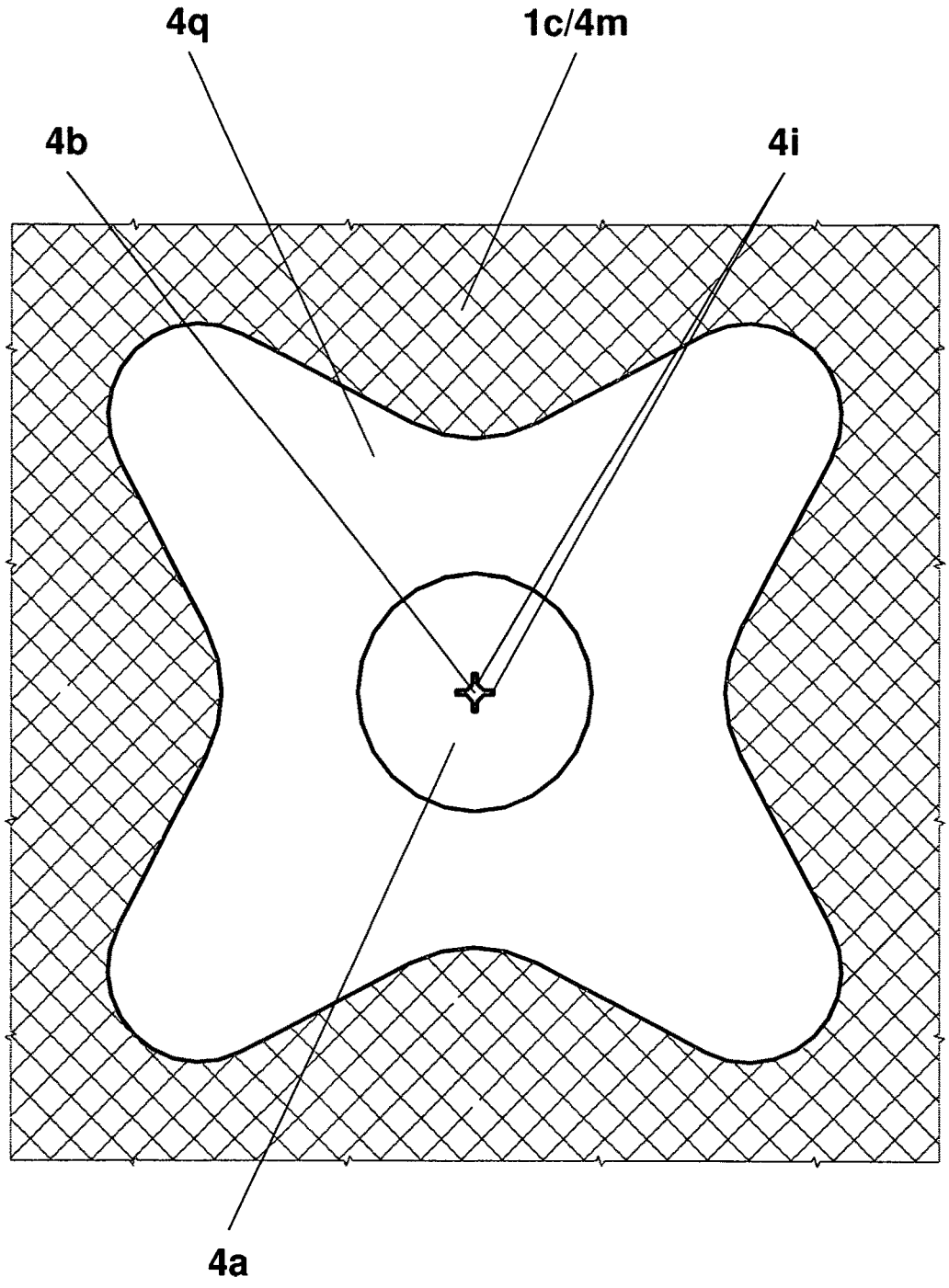
FIG. 6 fall arrester with integrated post cover without reinforcement (top plan view)

FIG. 6 shows the post stabiliser as explained in FIG. 5 in an embodiment without the reinforcements 4*g*, 4*h*.

FIG. 7 shows a cable holding device 2 with a post 2*a* and a stand element 2*b*, wherein the post 2*a* comprises in the middle section a helical bended post section 2*b*. The helical winding in the post section 2*d* causes an additional damping in the case of a fall. The post has a cable fixation 2*g* in the upper end section. In the shown example the cable fixation 2*g* consists of a ring-shaped opening. Alternatively, the cable fixation can consist of a snap-hook or of a bayonet catch.

The post 2*a* of the cable holding device 2 can also be designed in several parts and needs not pass over in the stand element 2*b* in one piece but can be connected with a post adapter as shown in the FIGS. 8 to 11.

Figure 8:
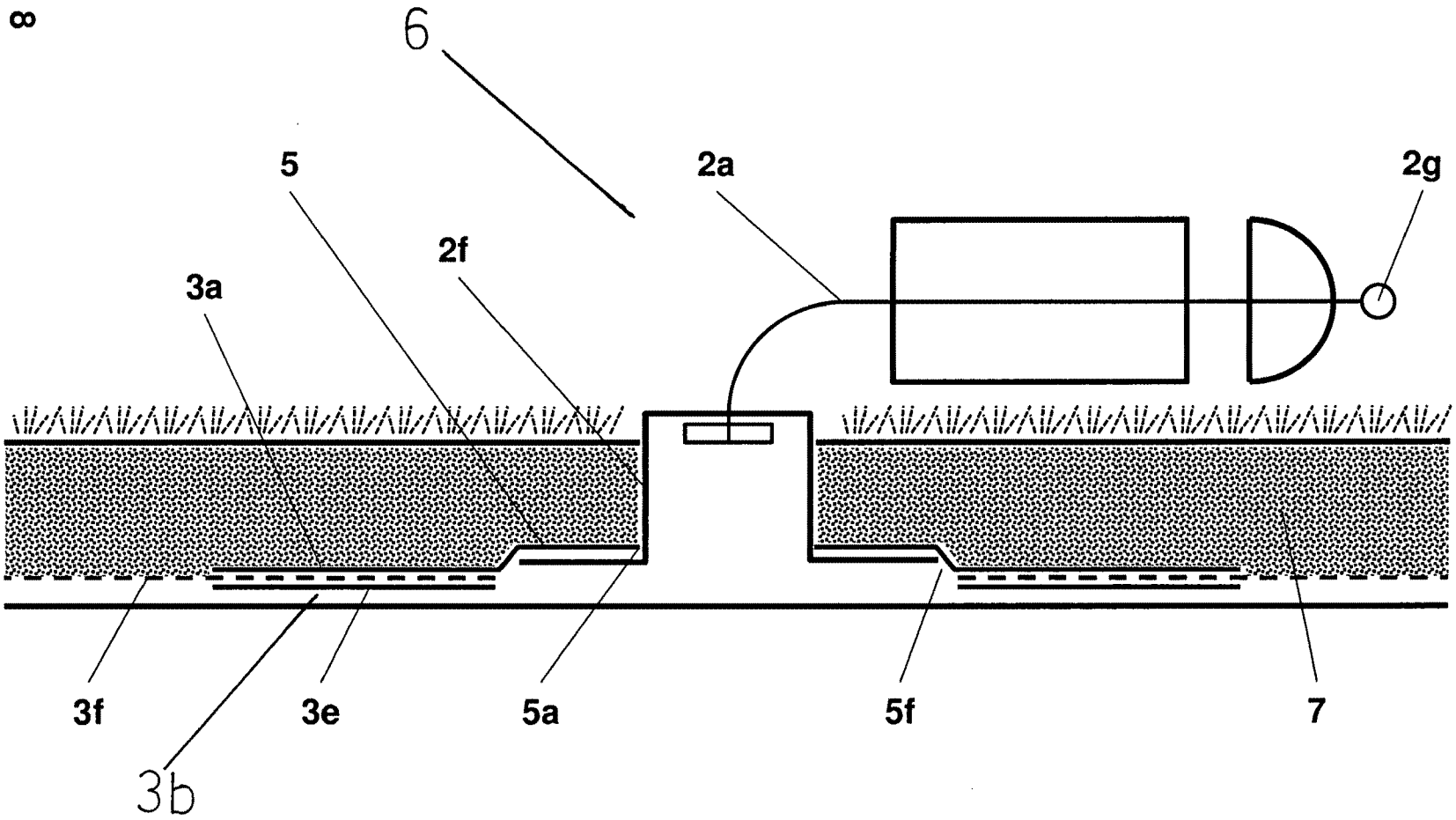

FIG. 8 shows the fall arrester device 6 with a multi-layer fall arrester section 3*b* and a post anchorage 5 under the load of the green covering of the roof 7.

The multi-layer fall arrester section 3*b* comprises the upper FRP layer 3*a*, the lower FRP layer 3*e* and the layer 3*f* made of a woven or non-woven fabric which enlarge the fall arrester area as ballast receiving element.

The post anchorage 5 serves as anchorage for the post adapter 2*f*. The post anchorage 5 comprises a recess 5*f* which corresponds in shape and size to the cross section of the upper section of the post adapter 2*f*. In the shown example the post 2*a* is built up in several parts, wherein the lower part which projects beyond the green covering of the roof 7 is formed by the U-shaped bended adapter 2*f*. To the post adapter 2*f* belong the lateral extensions which are arranged in the plane and on which upper side the post anchorage 5 rests which is integrated in the fall arrester. The U-shaped section of the post adapter 2*f* projects through the central opening 5*a* of the post anchorage and is accessible from the upper side for the fixation of the post 2*a*.

Figure 9:
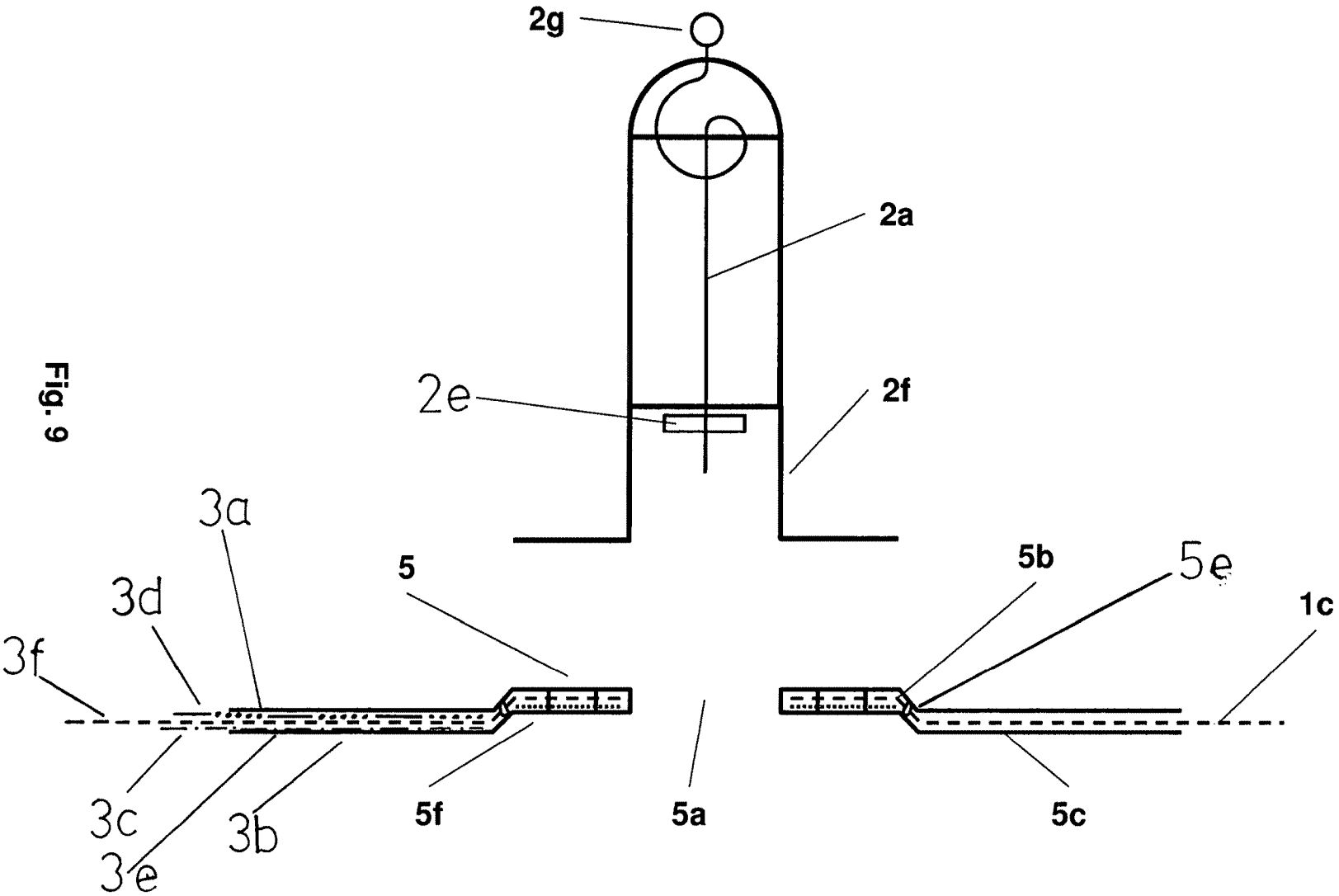

FIG. 9 shows the post anchorage 5 together with the post 2*a* which is fixed at the post adapter 2*f*. The post 2*a* is surrounded by a cover. In the case of a fall the post 2*a* is bended and the cover releases from its original position so that the load of the post is displayed. The post anchorage comprises the recess 5*f* at the bottom side. In the region of the opening 5*a* the post anchorage 5 is built up in a multi-layer manner, wherein the upper layer 5*b* and the lower layer 5*c* is made from a glass fiber reinforced material. Between the layers 5*b* and 5*c* the ballast receiving element 3*f*/1*c* is integrated for the enlargement of the fall arrester area.

The multi-layer fall arrester section 3*d* is formed beside the outer FRP layers 3*a*, 3*e* by reinforcement made of an elastic material 3*d*, the layer 3*f* made of a woven or non-woven fabric and the metal reinforcement 3*c*.

Figure 10:
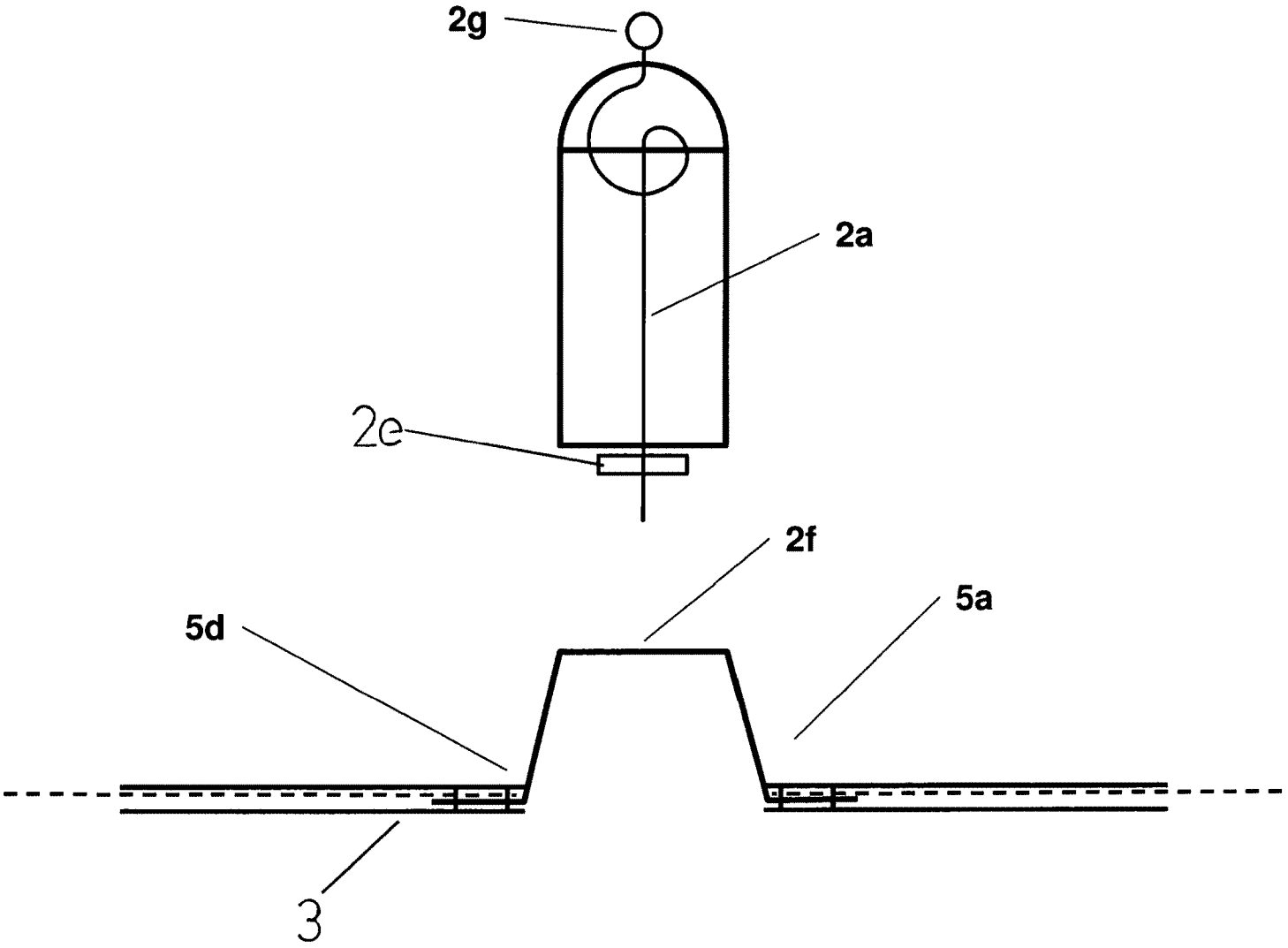

FIG. 10 shows the post adapter 2*f* which is integrated in the opening 5*a* of the post anchorage so that the lateral sections of the post adapter 2*f* project in the multi-layer designed fall arrester section 3 and are integrated there. The connection between the lateral sections of the post adapter 2*f* and the layers of the multi-layer fall arrester 3 in the region of the opening 5*a* can take place either by fixation means, like e. g. screws, or by an adhesive. To allow the penetration of the adhesive in the different layers openings are provided which are arranged vertical and penetrate the layers. The post 2*a* is connected with the post adapter 2*f* by the counter nut 2*e*. Instead of the counter nut 2*e* also a thread can be machined in the metallic post adapter 2*f* so that the post 2*a* can be fixed on it.

Figure 11:
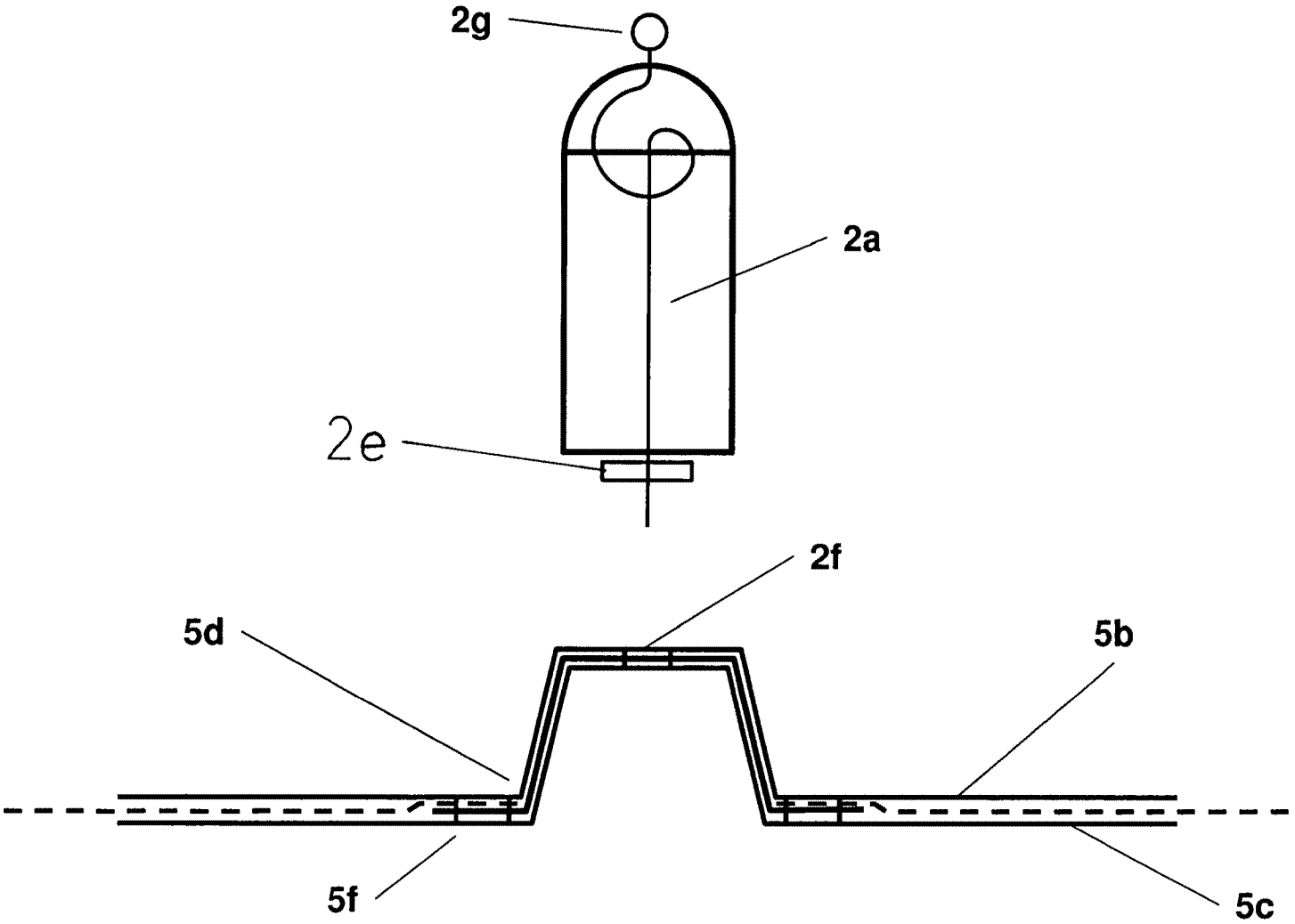

FIG. 11 shows a multi-layer designed post adapter 2*f* which lateral sections are integrated between the upper layer 5*b* and the lower layer 5*c*. The post adapter 2*f* has the reinforcement 5*d* in the region of the socle. The reinforcement 5*d* causes an additional stabilization of the post adapter 2*f* in the case of a fall as well as an improved damping. The post 2*a* is connected with the post adapter 2*f* by the counter nut 2*e*. Instead of the counter nut 2*e* also a thread can be machined in the post adapter 2*f* or a nut can be integrated in the multi-layer post adapter 2*f* made of FRP material so that the post 2*a* can be fixed on it without a counter nut.

Figure 12:
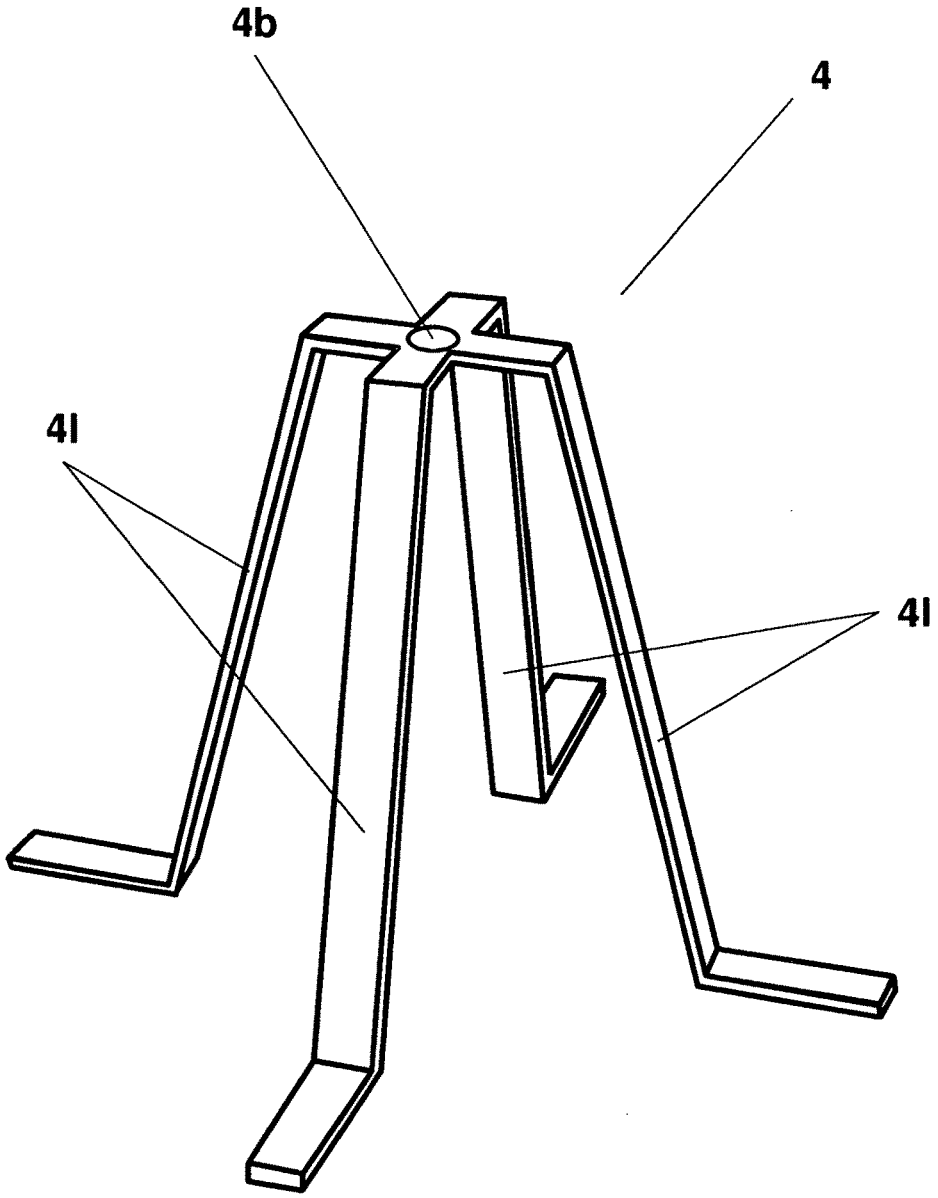

FIG. 12 shows a post stabiliser 4 which consists of two flat steel sheet metal which are bended substantially U-shaped, wherein the two U-shaped bended sheet metals, which form together four cross struts 4*l*, are arranged perpendicular to another so that the post stabiliser 4 offers a uniform stabilization against a post which is inserted into the stabiliser which is bent into the plane in the case of a fall. The upper aperture 4*b* of the stabiliser 4 is provided for the lead-through of the post.

Figure 13:
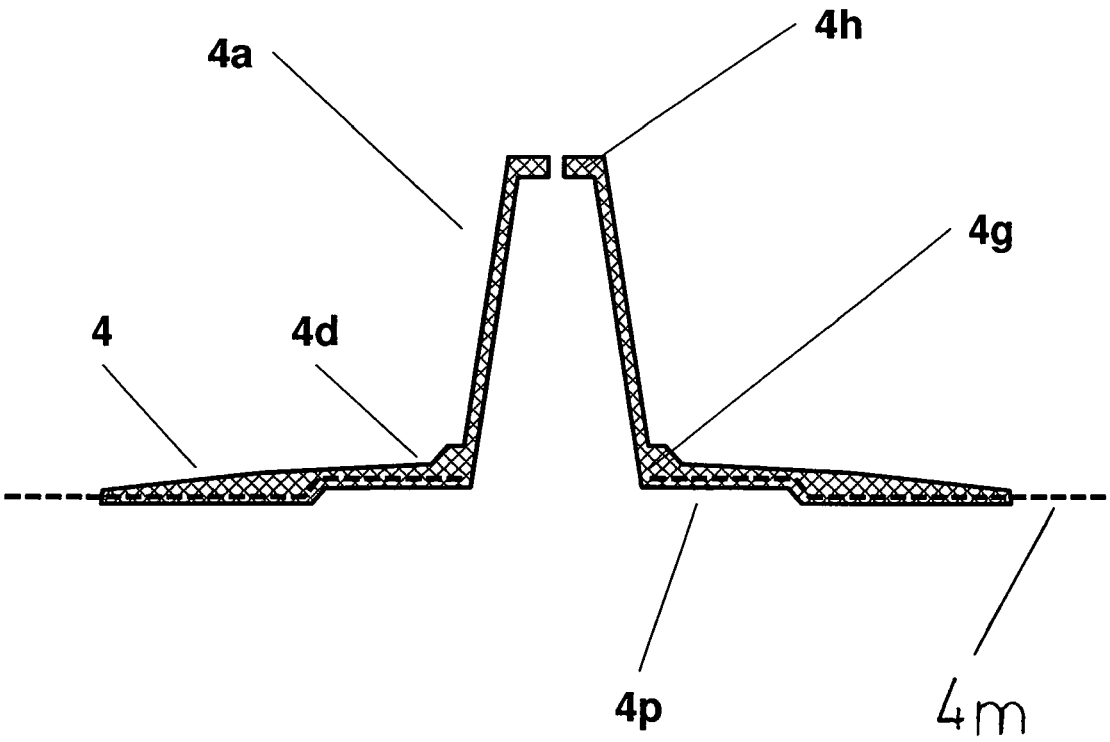

FIG. 13 shows a post stabiliser 4 which is designed as cone-shaped post cover 4*a*. The speciality of the shown post cover 4*a* is that this comprises in the socle area 4*d* the lower reinforcement 4*g* and in the region of the upper end section of the post cover 4*a* the upper reinforcement 4*h*. The two reinforcements 4*g* and 4*h* cause in the case of a fall an additional stabilization of the post cover. The lower reinforcement 4*g* causes especially an improved connection between the post cover and the socle area of the post stabiliser 4.

Figure 14:
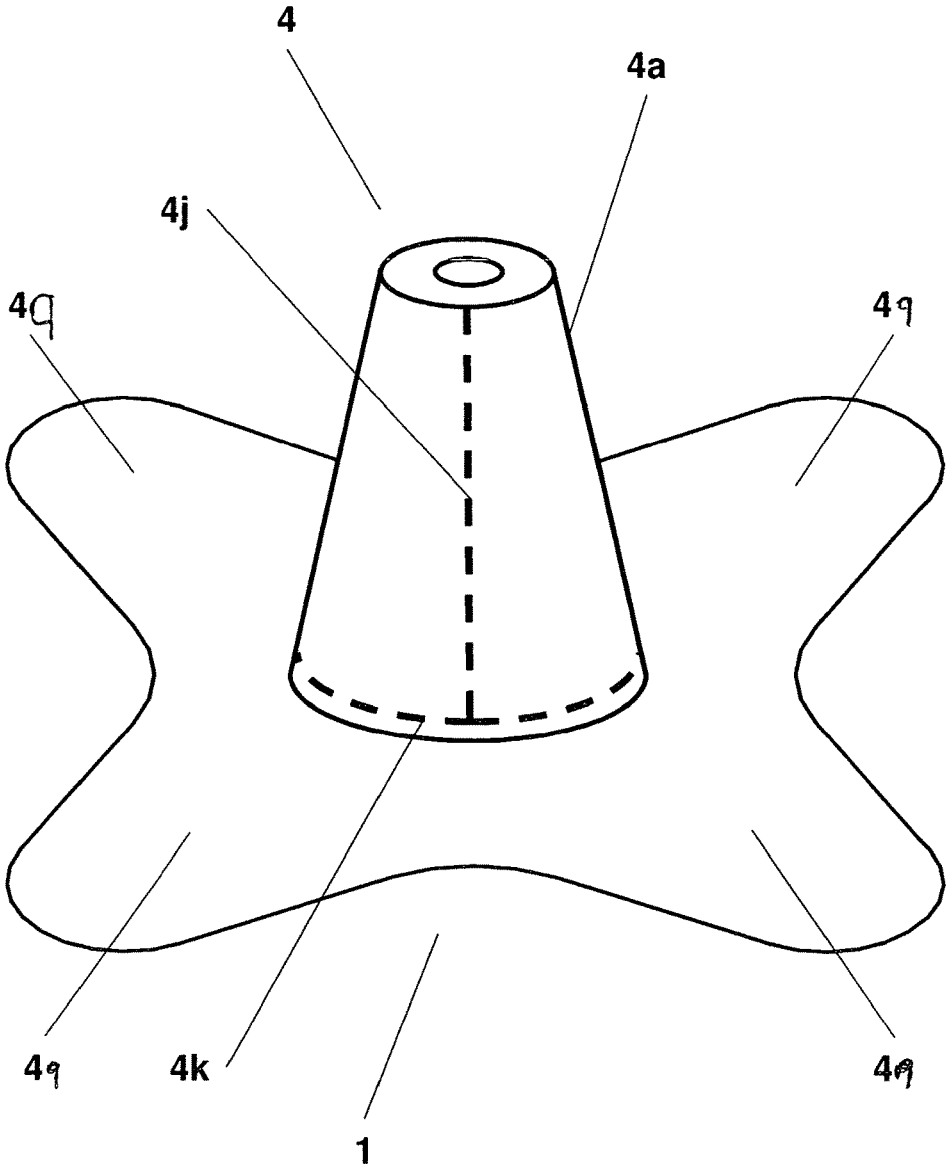

FIG. 14 shows a post stabiliser 4 which post cover 4*a* has a cone-shape. In the region of the surface shell the post cover 4*a* has the predetermined breaking point 4*j*. In the region of the socle 4*d* the post cover 4*a* has the predetermined breaking point 4*k*. The predetermined breaking point 4*j* can be punctual or as shown in the example can consist of a plurality of predetermined breaking points which are arranged in a line. The same applies for the predetermined breaking point 4*k* in the region of the socle 4*d*. In the shown example the predetermined breaking point 4*j* consists of a plurality of punctual predetermined breaking points which are arranged one after the other. For the enlargement of the resting area the post stabiliser 4 as shown in FIG. 14 has in total four lug-like ballast receiving elements 4*q*. The lug-like ballast receiving elements 4*q* are preferably designed at least in a two-layer manner, wherein the upper layer and the lower layer respectively consist of a material which is reinforced by glass fibers. Thereby the lug-like enlargements 4*q* are flexible and can be flapped upward or downwards for the transport of the post stabiliser.

LIST OF REFERENCES

1 Fall arrester
1*a* Upper layer made of a glass fibre reinforced material
1*b* Lower layer made of a glass fibre reinforced material
1*c* Receiving element for ballast for the enlargement of the fall arrester area
1*d* Grid fall arrester for the enlargement of the fall arrester area
2 Cable holding device
2*a* Post of the cable holding device
2*b* Stand element of the holding device for the cable
2*c* Stand element made of a helically bended profile
2*d* Post section made of a helically bended profile
2*e* Fixation element for the post (counter nut)
2*f* Post adapter
2*g* Cable fixation (fixation element for the safety rope)
3 Multi-layer section of the fall arrester arrangement
3*a* Upper layer made of a glass fibre reinforced material
3*b* Multi-layer fall arrester section
3*c* Reinforcement made of metal
3*d* Reinforcement made of an elastic material
3*e* Lower layer made of a glass fibre reinforced material
3*f* Woven or non-woven fabric
4 Post stabiliser
4*a* Cone-shaped post cover as post stabiliser
4*b* Upper aperture of the post cover
4*c* Lower aperture of the post cover
4*d* Socle of the post cover
4*e* Upper layer made of a glass fibre reinforced material
4*f* Lower layer made of a glass fibre reinforced material
4*g* Lower reinforcement of the post stabiliser
4*h* Upper reinforcement of the post stabiliser
4*i* Predetermined breaking point in the region of the upper side of the post cover
4*j* Predetermined breaking point in the region of the shell of the post cover
4*k* Predetermined breaking point in the region of the socle of the post cover
4*l* Post stabiliser with integrated cross struts
4*m* Woven or non-woven fabric
4*n* Metal
4*o* Polymer
4*p* Recess at the lower side of the post cover
4*q* Receiving element for ballast for the enlargement of the area of support of the post stabiliser
5 Post anchorage (lying in the plane of the fall arrester)
5*a* Opening of the post anchorage
5*b* Upper layer made of a glass fibre reinforced material
5*c* Lower layer made of a glass fibre reinforced material
5*d* Reinforcement of the post anchorage
5*e* Predetermined breaking point of the post anchorage
5*f* Recess at the lower side of the post anchorage
6 Fall arrester device
7 Green covering of the roof

The invention claimed is:

1. A fall arrester device, comprising:

a fall arrester for a cable holding device with a post, wherein the fall arrester is a flat, ballast receiving device disposable below a roof covering and can be installed without a roof penetration, and the fall arrester has a multi-layer section with multiple layers; and a damping element connected to the fall arrester and including at least one of a post stabiliser configured to surround a surface shell of the post at least partially and extend in a vertical direction at least up to one third of a total height of the post or a post anchorage configured to receive the post or a post adapter, the damping element being integrated into the multi-layer section, such that the damping element includes the multiple layers in at least one section thereof, wherein the multiple layers of each of the multi-layer section of the fall arrester and the at least one section of the damping element include a fiber-reinforced layer made of composite material reinforced with at least one of glass fibers or carbon fibers.

2. The fall arrester device according to claim 1, wherein the fall arrester includes additional receiving elements for ballast serving for enlargement of an area of the fall arrester, and at least part of an area of the fiber-reinforced layer rests on an upper side of the additional receiving elements.

3. The fall arrester device according to claim 1, wherein the damping element is the post stabiliser, and the fiber-reinforced layer comprises a layer made of a glass fiber reinforced composite material, wherein the fiber-reinforced layer forms a continuous layer through the multi-layer section of the fall arrester and the at least one section of the damping element.

4. The fall arrester device according to claim 3, wherein the post stabiliser is a post cover and the at least one section of the damping element comprises a socle of the post stabiliser arranged in a plane, wherein the socle is connected with the fall arrester, the multiple layers of the at least one section of the damping element comprise a structure having at least three layers, and wherein a topmost layer of the socle and a lowermost layer of the socle each consist of the fiber-reinforced layer.

5. The fall arrester device according to claim 4, wherein the socle of the post stabiliser further comprises a layer made of at least one of a fabric, a bendable metal, or an elastic polymer.

6. The fall arrester device according to claim 1, wherein the damping element is the post anchorage with a center opening for the reception of the post or the post adapter and an edge region of the center opening comprises the fiber-reinforced layer.

7. The fall arrester device according to claim 1, wherein the damping element has at least one predetermined breaking point.

8. The fall arrester device according to claim 7, wherein the damping device is the post stabiliser and the at least one predetermined breaking point is disposed in a region of an upper side opening of the port stabiliser, in a region of a surface shell of the post stabiliser, or in a region of a socle of the post stabiliser which is connected with the fall arrester.

9. The fall arrester device according to claim 8, wherein the post stabiliser comprises in the region of the upper side opening at least three predetermined breaking points, and wherein the at least three predetermined breaking points are designed as insections or as longitudinal openings arranged with the same distance to one another respectively starting from the upper side opening.

10. The fall arrester device according to claim 1, wherein the fall arrester comprises at least two flat receiving elements for ballast for the enlargement of the fall arrester area which are arranged to another equidistantly about a center of the fall arrester, wherein an upper side or a lower side of the receiving elements for ballast are connected with the fiber-reinforced layer which is also part of the damping element.

11. The fall arrester device according to claim 1, wherein the multiple layers of the at least one section of the damping element and the multi-layer section of the fall arrester comprise at least three layers, and each of a topmost layer and a lowermost layer of the at least three layers consists of the fiber-reinforced layer.

12. A post stabiliser device, comprising:

a post stabiliser for a cable holding device that has a post and a stand element, wherein the post stabiliser includes an upper aperture in the region of an upper side and a lower aperture in the region of a lower side for the reception of the post, and wherein the post stabiliser envelopes a surface shell of the post at least partially and extends in a vertical direction at least up to one third of a total height of the post, and wherein the post stabiliser includes a multi-layer section with multiple layers, at least one layer of the multiple layers comprises a composite material reinforced by glass fibers.

13. The post stabiliser according to claim 12, wherein the post stabiliser is a post cover, and the post stabiliser comprises at least on predetermined breaking point.

14. The post stabiliser according to claim 13, wherein the multi-layer section of the post stabiliser is part of a socle of the post stabiliser which is connected with the fall arrester, and the multi-layer section further comprises at least one layer made of a fabric, a bendable metal, or an elastic polymer.

15. The post stabiliser according to claim 12, wherein the multiple layers of the multi-layer section include at least three layers, and each of the two outermost layers of the multi-layer section consists of the fiber-reinforced layer.

* * * * *